US009372430B2

(12) United States Patent
Saiki et al.

(10) Patent No.: US 9,372,430 B2
(45) Date of Patent: Jun. 21, 2016

(54) IMAGE FORMING APPARATUS INCLUDING LENS ARRAY OPTICAL SYSTEM, IMAGE PROCESSING APPARATUS, PROGRAM PRODUCT, AND STORAGE MEDIUM

(71) Applicant: CANON KABUSHIKI KAISHA, Tokyo (JP)

(72) Inventors: Tomoyuki Saiki, Tokyo (JP); Takeyoshi Saiga, Tokyo (JP); Yu Miyajima, Utsunomiya (JP); Shimpei Matsuo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/551,368

(22) Filed: Nov. 24, 2014

(65) Prior Publication Data

US 2015/0160581 A1 Jun. 11, 2015

(30) Foreign Application Priority Data

Dec. 6, 2013 (JP) ..... 2013-253614

(51) Int. Cl.

| | |
|---|---|
| ***B41J 2/45*** | (2006.01) |
| ***G03G 15/043*** | (2006.01) |
| ***G03G 15/04*** | (2006.01) |

(52) U.S. Cl.

CPC ..... *G03G 15/043* (2013.01); *G03G 15/0409* (2013.01)

(58) Field of Classification Search

CPC ... G03G 15/043; G03G 15/0409; B41J 2/447; B41J 2/45; B41J 2/465; B41J 2/47

USPC ..... 347/230, 236, 237, 241, 244, 246, 247, 347/256, 258

See application file for complete search history.

(56) References Cited

U.S. PATENT DOCUMENTS 6,021,300 A 2/2000 Jeong
7,119,826 B2 * 10/2006 Nojima ..... B41J 2/451 347/244

(Continued)

FOREIGN PATENT DOCUMENTS

JP 9-118040 A 5/1997
JP 2001-205845 A 7/2001

(Continued)

OTHER PUBLICATIONS

U.S. Appl. No. 14/549,775, filed Nov. 21, 2014 to Tomoyuki Saiki et al.

(Continued)

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

An image forming apparatus includes: a photosensitive member; and an exposure unit. The exposure unit includes a lens array optical system in which a plurality of lenses are disposed along a predetermined direction, and a light-emitting unit having a plurality of light-emitting elements disposed so as to expose, through the lens array optical system, every Lth pixel in L scanning lines of the photosensitive member. An interval of locations, in a main arrangement direction, that correspond to adjacent lenses in the lens array optical system is configured to be an interval based on the value of L.

15 Claims, 19 Drawing Sheets

(56) References Cited

U.S. PATENT DOCUMENTS

| | | | | |
|---|---|---|---|---|
| 7,929,177 | B2 * | 4/2011 | Inoue | G06K 15/1209 347/118 |
| 8,208,172 | B2 | 6/2012 | Takayama et al. | |
| 8,724,033 | B2 | 5/2014 | Toyooka | |
| 8,849,134 | B2 | 9/2014 | Ogawa et al. | |
| 8,922,863 | B2 | 12/2014 | Tokita et al. | |
| 2004/0189786 | A1 | 9/2004 | Yamakawa | |
| 2010/0202059 | A1 * | 8/2010 | Yamamura | B41J 2/451 359/619 |
| 2013/0293913 | A1 | 11/2013 | Takayama et al. | |
| 2013/0308166 | A1 | 11/2013 | Uchidate et al. | |
| 2015/0160581 | A1 * | 6/2015 | Saiki | G03G 15/0409 399/51 |

FOREIGN PATENT DOCUMENTS

| | | | |
|---|---|---|---|
| JP | 2003-72142 | A | 3/2003 |
| JP | 2004-188845 | A | 7/2004 |
| JP | 2006-255976 | A | 9/2006 |
| JP | 2011-5804 | A | 1/2011 |

OTHER PUBLICATIONS

U.S. Appl. No. 14/549,775, filed Nov. 21, 2014.

* cited by examiner

| | | | | | | | | | | | | | | |
|---|---|---|---|---|---|---|---|---|---|---|---|---|---|---|
| $A_0$ | $A_1$ | $A_2$ | $A_3$ | $A_4$ | $A_5$ | $A_6$ | $A_7$ | $A_8$ | ··· | $A_{4995}$ | $A_{4996}$ | $A_{4997}$ | $A_{4998}$ | $A_{4999}$ |
| $B_0$ | $B_1$ | $B_2$ | $B_3$ | $B_4$ | $B_5$ | $B_6$ | $B_7$ | $B_8$ | ··· | $B_{4995}$ | $B_{4996}$ | $B_{4997}$ | $B_{4998}$ | $B_{4999}$ |
| $C_0$ | $C_1$ | $C_2$ | $C_3$ | $C_4$ | $C_5$ | $C_6$ | $C_7$ | $C_8$ | ··· | $C_{4995}$ | $C_{4996}$ | $C_{4997}$ | $C_{4998}$ | $C_{4999}$ |

⋮

| | | | | | | | | | | | | | | |
|---|---|---|---|---|---|---|---|---|---|---|---|---|---|---|
| $A_0$ | | $A_2$ | | $A_4$ | | $A_6$ | | $A_8$ | ··· | | $A_{4996}$ | | $A_{4998}$ | |
| $B_0$ | $A_1$ | $B_2$ | $A_3$ | $B_4$ | $A_5$ | $B_6$ | $A_7$ | $B_8$ | ··· | $A_{4995}$ | $B_{4996}$ | $A_{4997}$ | $B_{4998}$ | $A_{4999}$ |
| $C_0$ | $B_1$ | $C_2$ | $B_3$ | $C_4$ | $B_5$ | $C_6$ | $B_7$ | $C_8$ | ··· | $B_{4995}$ | $C_{4996}$ | $B_{4997}$ | $C_{4998}$ | $B_{4999}$ |
| $D_0$ | $C_1$ | $D_2$ | $C_3$ | $D_4$ | $C_5$ | $D_6$ | $C_7$ | $D_8$ | | $C_{4995}$ | $D_{4996}$ | $C_{4997}$ | $D_{4998}$ | $C_{4999}$ |

⋮

| DETERMINATION CONDITIONS | DELAY AMOUNT Dly |
|---|---|
| COUNTER VALUE Cnt IS EVEN | 0 |
| COUNTER VALUE Cnt IS ODD | 1 |

FIG. 16A

| | | | | | | | | | | | | |
|---|---|---|---|---|---|---|---|---|---|---|---|---|
| $A_0$ | $A_1$ | $A_2$ | $A_3$ | $A_4$ | $A_5$ | $A_6$ | $A_7$ | $A_8$ | ··· | $A_{4995}$ | $A_{4996}$ | $A_{4997}$ |
| $B_0$ | $B_1$ | $B_2$ | $B_3$ | $B_4$ | $B_5$ | $B_6$ | $B_7$ | $B_8$ | ··· | $B_{4995}$ | $B_{4996}$ | $B_{4997}$ |
| $C_0$ | $C_1$ | $C_2$ | $C_3$ | $C_4$ | $C_5$ | $C_6$ | $C_7$ | $C_8$ | ··· | $C_{4995}$ | $C_{4996}$ | $C_{4997}$ |

⋮

FIG. 16B

| | | | | | | | | | | | | |
|---|---|---|---|---|---|---|---|---|---|---|---|---|
| $A_0$ | | | $A_3$ | | | $A_6$ | | | ··· | $A_{4995}$ | | |
| $B_0$ | $A_1$ | | $B_3$ | $A_4$ | | $B_6$ | $A_7$ | | ··· | $B_{4995}$ | $A_{4996}$ | |
| $C_0$ | $B_1$ | $A_2$ | $C_3$ | $B_4$ | $A_5$ | $C_6$ | $B_7$ | $A_8$ | ··· | $C_{4995}$ | $B_{4996}$ | $A_{4997}$ |
| | $C_1$ | $B_2$ | | $C_4$ | $B_5$ | | $C_7$ | $B_8$ | | | $C_{4996}$ | $B_{4997}$ |
| | | $C_2$ | | | $C_5$ | | | $C_8$ | | | | $C_{4997}$ |

⋮

FIG. 16C

| DETERMINATION CONDITIONS | DELAY AMOUNT Dly |
|---|---|
| MOD (Cnt, 3) == 0 | 0 |
| MOD (Cnt, 3) == 1 | 1 |
| MOD (Cnt, 3) == 2 | 2 |

IMAGE FORMING APPARATUS INCLUDING LENS ARRAY OPTICAL SYSTEM, IMAGE PROCESSING APPARATUS, PROGRAM PRODUCT, AND STORAGE MEDIUM

BACKGROUND OF THE INVENTION

1. Field of the Invention

The present disclosure relates to image processing techniques used in image forming apparatuses that include a lens array optical system.

2. Description of the Related Art

An image forming apparatus that exposes a photosensitive member using an exposure unit that employs a lens array optical system having a lens array has been developed. The exposure unit that employs the lens array optical system is small in size and contains few components, which is useful in making the image forming apparatus smaller and cheaper. However, with a lens array optical system, unnecessary ghost light is produced in addition to a light flux for forming a desired image on an image surface (in an image forming apparatus, the surface of the photosensitive member). A configuration that reduces such ghost light by disposing a light-blocking member between lens plates that configure the lens array optical system is known. However, in this configuration, light is scattered and reflected by the light-blocking member, and thus ghost light is produced here as well. Japanese Patent Laid-Open No. 9-118040 discloses a configuration that provides non-planarities in the surface of a light-blocking member, which suppresses ghost light from being scattered and reflected by the light-blocking member and traveling toward the image surface.

However, the configuration disclosed in Japanese Patent Laid-Open No. 9-118040 complicates the shape and increases the size of the light-blocking member, and as such further measures are needed from the standpoint of structure, size, and so on.

SUMMARY OF THE INVENTION

According to an aspect of the present invention, an image forming apparatus includes: a photosensitive member; and an exposure unit, including a lens array optical system in which a plurality of lenses are disposed along a predetermined direction, and a light-emitting unit having a plurality of light-emitting elements disposed so as to expose, through the lens array optical system, every Lth pixel in L scanning lines of the photosensitive member, wherein an interval of locations, in a main arrangement direction, that correspond to adjacent lenses in the lens array optical system is configured to be an interval based on the value of L.

Further features of the present invention will become apparent from the following description of exemplary embodiments with reference to the attached drawings.

BRIEF DESCRIPTION OF THE DRAWINGS

FIGS. 16A to 16C are diagrams illustrating delay processing according to an embodiment.

DESCRIPTION OF THE EMBODIMENTS

Hereinafter, exemplary embodiments of the present invention will be described with reference to the drawings. Note that constituent elements not necessary for the descriptions of the embodiments have been omitted from the drawings. Note also that the following embodiments are to be taken as examples only, and the content of the embodiments is not intended to limit the scope of the present invention.

First Embodiment

Figure 1A:
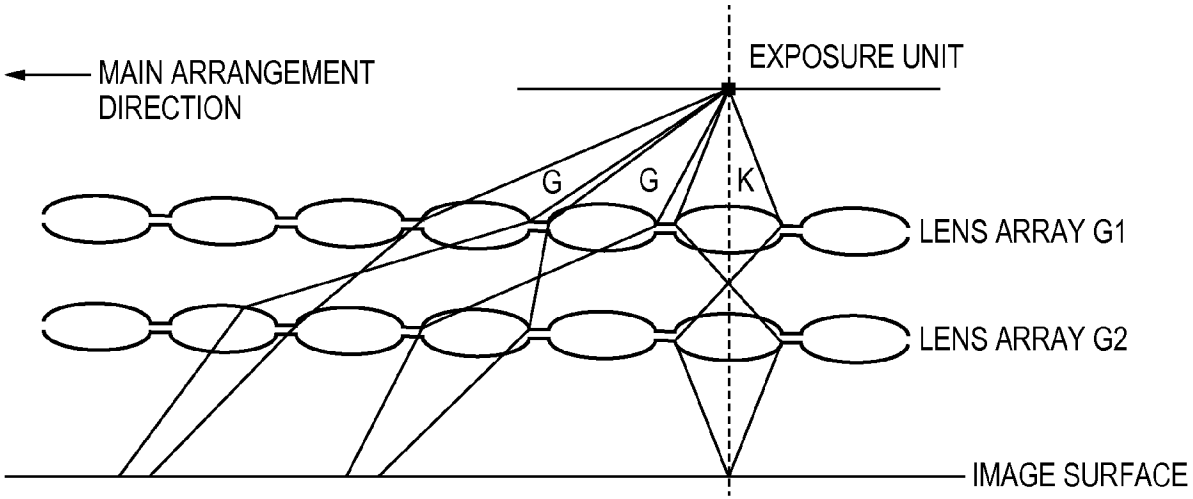
FIGS. 1A and 1B are diagrams illustrating a principle behind the production of ghost light in a lens array optical system.
Figure 1B:
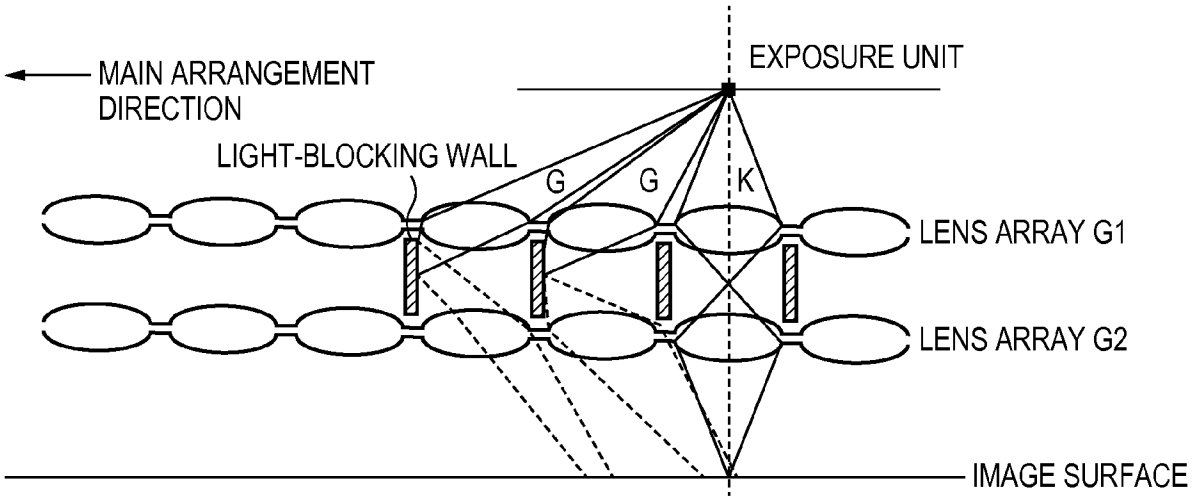

FIGS. 1A and 1B are diagrams illustrating ghost light produced in a lens array optical system. In FIGS. 1A and 1B, a light-emitting unit is, for example, an LED array having a plurality of light-emitting surfaces. Lens arrays G1 and G2 each have a plurality of lenses disposed in matrix form in a predetermined direction. This predetermined direction will be referred to as a main arrangement direction hereinafter. At several tens of μm, the interval between light-emitting surfaces in the LED array is significantly narrower than the interval between lenses in the lens arrays, which is at least several hundreds of μm, and thus the light-emitting surfaces in the light-emitting unit can be thought of as being essentially continuous. Note that FIGS. 1A and 1B illustrate an optical path from only a single point along the continuous light-emitting surfaces in the light-emitting unit, in order to simplify the descriptions. In FIG. 1A, a light flux K from a single light emission point in the light-emitting unit is a light flux for forming a desired image on a photosensitive member (image surface). Meanwhile, a light flux G represents ghost light from that light emission point. As shown in FIG. 1A, after passing through a given lens in the lens array G1, a light flux that travels toward a lens in the lens array G2 on a different optical axis than the first lens becomes ghost light. FIG. 1B illustrates a light-blocking wall being provided between the lens array G1 and the lens array G2 in order to reduce the ghost light shown in FIG. 1A. Although the light-blocking wall absorbs some of the ghost light, the remaining ghost light is reflected; ghost light indicated by a dotted line in FIG. 1B remains, and causes the image formed on the photosensitive member to degrade. The present embodiment provides an image forming apparatus capable of suppressing the influence of such ghost light.

Figures 2A, 2B:
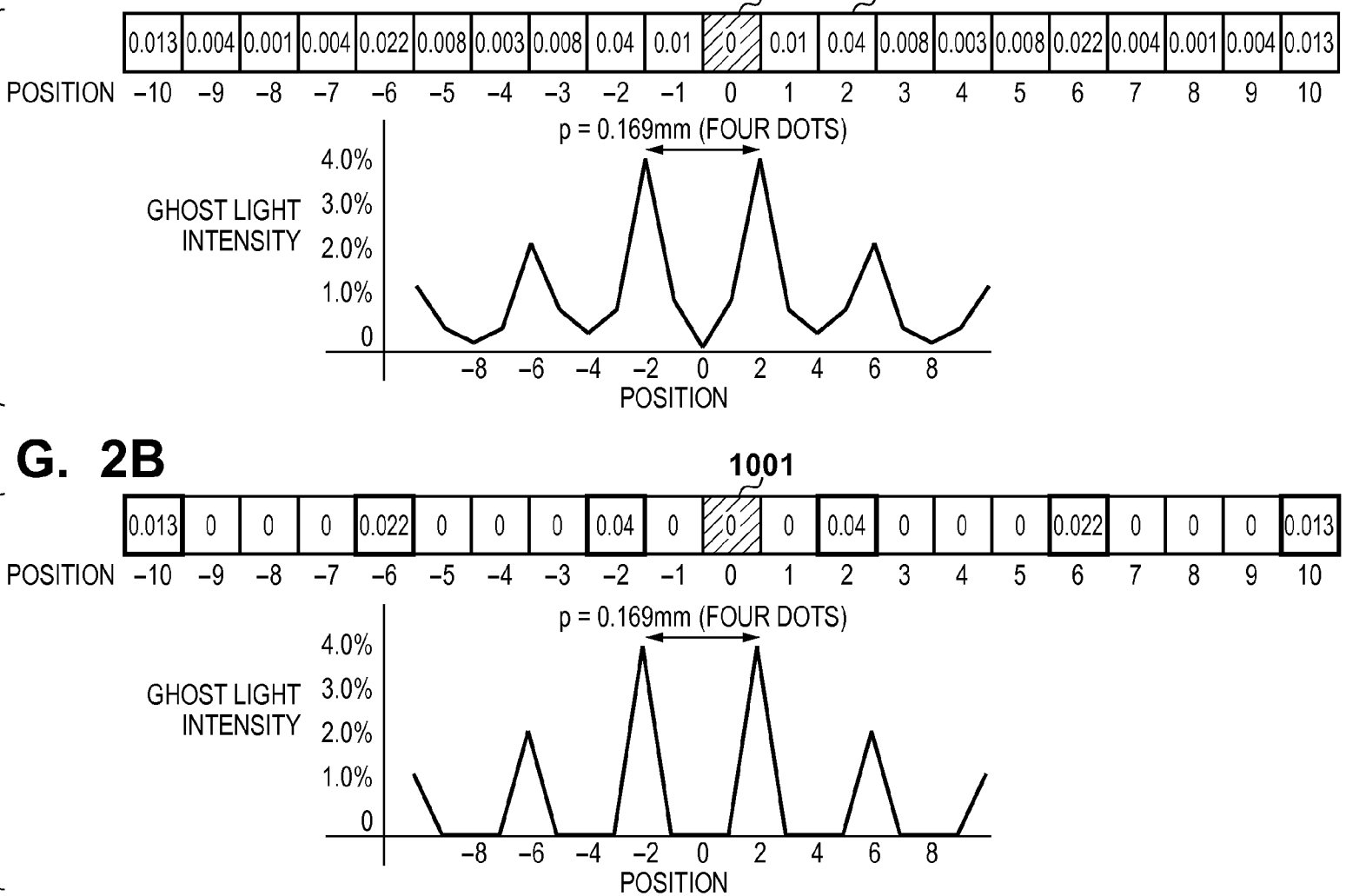
FIGS. 2A and 2B are diagrams illustrating ghost light characteristics and a ghost light profile according to an embodiment.

FIG. 2A is a diagram illustrating an example of ghost light produced in a lens array optical system 102. FIG. 2A illustrates a ratio or percentage of light, of light emitted from light-emitting units in the periphery of a light-emitting unit corresponding to a pixel of interest 1001, that is irradiated as ghost light at the position of the pixel of interest on the photosensitive member. As shown in FIG. 2A, when a relationship between the positions, relative to the pixel of interest 1001, of the light-emitting units that produce ghost light at the position of the pixel of interest 1001, and the stated percentage are graphed, peaks appear at a constant interval. Note that the strength of the peaks is greater the closer the light-emitting unit is to the light-emitting unit corresponding to the pixel of interest 1001. This interval is determined by optical design values of the lens array optical system, and this interval C is equal to a light-blocking wall cycle, or in other words, to the distance between identical locations in adjacent lenses in the lens array optical system (an arrangement pitch p).

Figure 3A:
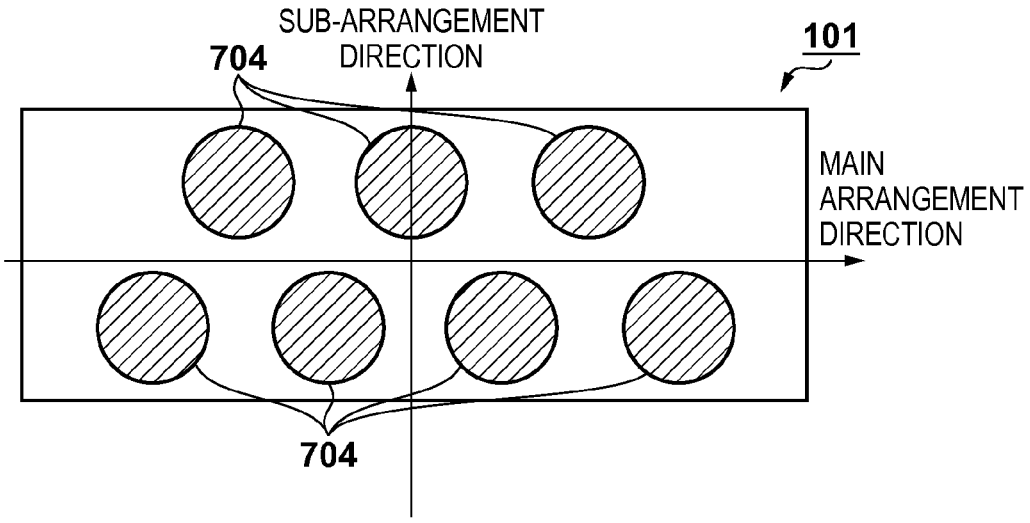
FIGS. 3A and 3B are diagrams illustrating a light source unit according to an embodiment.
Figure 3B:
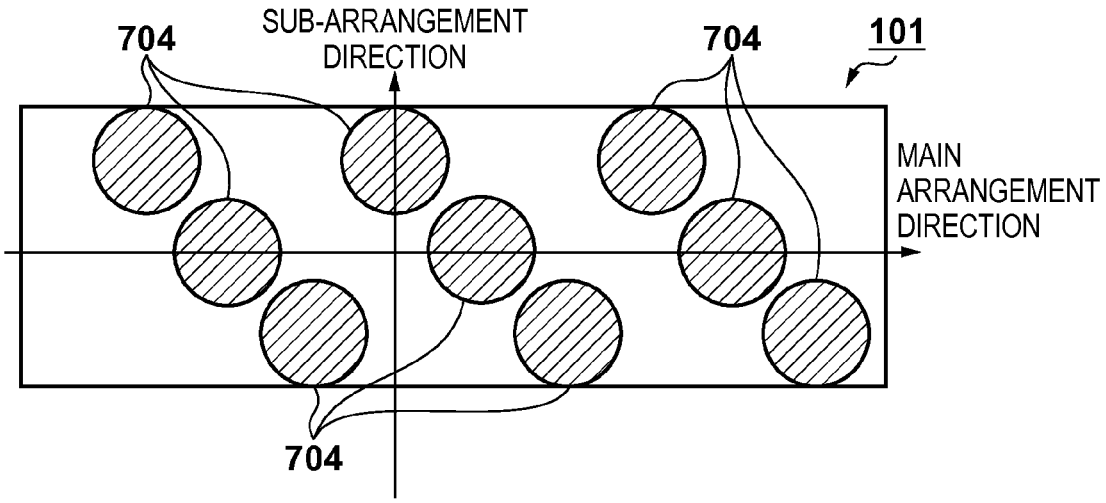

In the present embodiment, the light source unit is configured so that L columns of an array of LEDs (light-emitting units), which serve as light-emitting elements, disposed at equal intervals in the main arrangement direction, are disposed in a sub-arrangement direction that is orthogonal to both the main arrangement direction and an optical axis direction of the lens array optical system. Note that the configuration is such that in the sub-arrangement direction, the positions of the LEDs are skewed, and light-emitting units in the same column simultaneously expose pixels in the same scanning line of the photosensitive member. FIG. 3A illustrates a case where L=2 and FIG. 3B illustrates a case where L=3; a state in which L columns of a plurality of light-emitting units 704 disposed in the main arrangement direction of the light source unit 101 are provided in the sub-arrangement direction. In the present embodiment, the lens array optical system is designed so that, for the pixels corresponding to light-emitting units that produce ghost light intensity peaks at the position of the pixel of interest, the interval from an adjacent pixel is approximately 2×L×n (where n is a given integer of no less than 1) pixels (dots). To rephrase, the lens array optical system is designed so that for a given light-emitting unit, an interval between peaks of ghost light produced at positions aside from the position of the pixel of interest corresponding to that light-emitting unit, is 2×L×n dots. According to this configuration, the influence of the ghost light can be suppressed at a low cost, as will be described later. As described above, the arrangement pitch p in the lens array optical system may be set to 2×L×n (dots) in order to ensure that the interval between ghost light peaks is 2×L×n (dots).

For example, assuming that L=2 and n=1, the arrangement pitch p is four dots, and in the case of a resolution of 600 dpi, the arrangement pitch p will be 0.169 mm. FIG. 2A illustrates a ratio or percentage of the light fluxes emitted from the light-emitting units 704 corresponding to ten pixels to the left and right of the pixel of interest 1001 that is irradiated at the pixel of interest 1001 as ghost light. For example, FIG. 2A indicates that 4% of the light flux emitted from the light-emitting unit 704 corresponding to a pixel 1002 will be irradiated at the pixel of interest 1001 as ghost light.

FIG. 2B illustrates an example of a ghost light profile according to the present embodiment. In the present embodiment, the ghost light profile has only the values corresponding to the intensity peaks, with other areas having a value of 0, in a ghost light intensity distribution produced by the lens array optical system shown in FIG. 2A. Portions enclosed in a bold line in FIG. 2B correspond to pixels having the peaks shown in FIG. 2A. Although a ghost light profile for 21 pixels is used in the present embodiment, the number of pixels may be increased/decreased in accordance with the state of the ghost light production. Furthermore, although the present embodiment applies the same ghost light profile to all of the pixels, a configuration in which, for example, different ghost light profiles are used for each different pixel can also be employed. The ghost light profile can also be determined when the lens array optical system is designed, as well as through individual measurement after the lens array optical system is manufactured.

Figure 4:
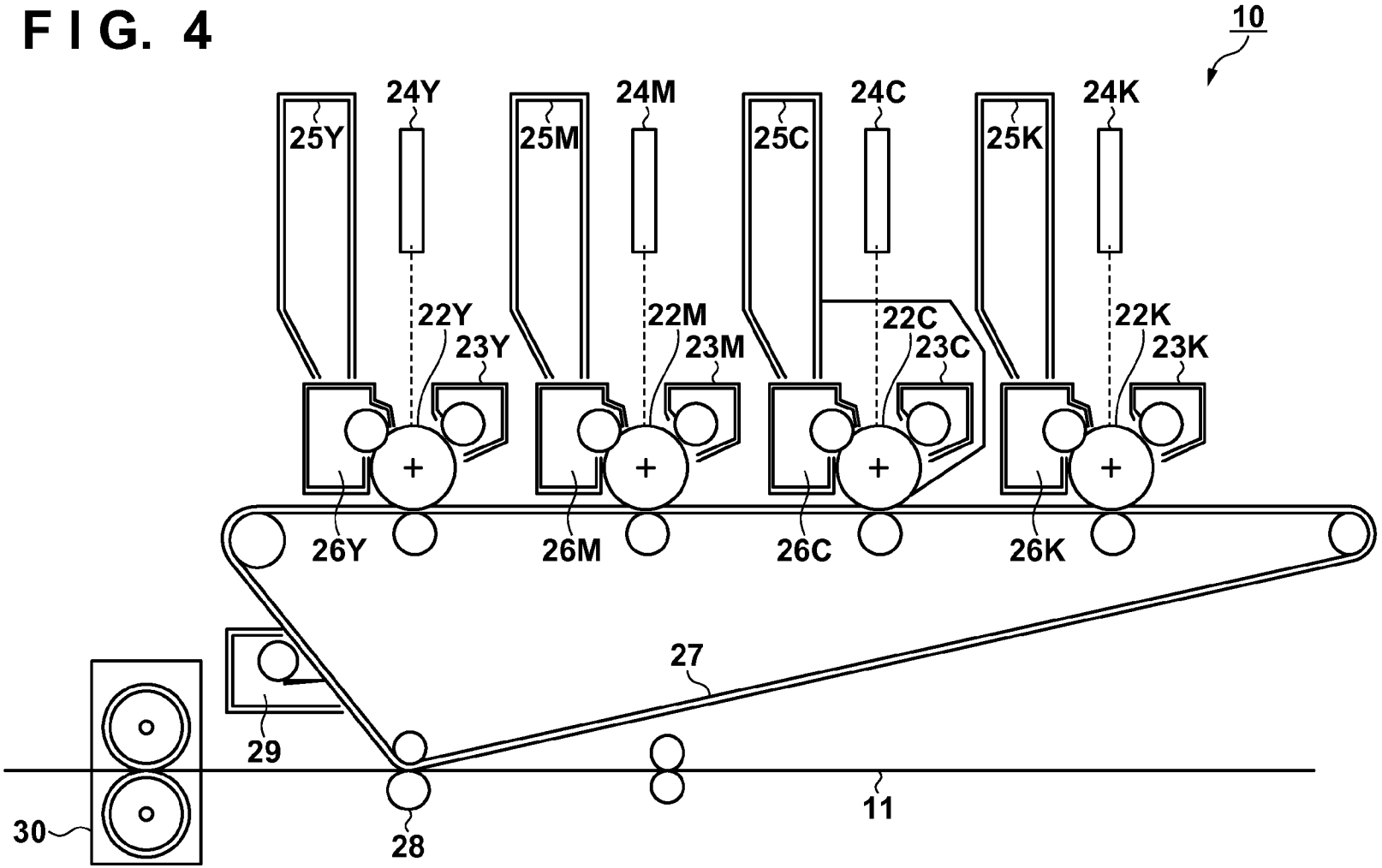
FIG. 4 is block diagram illustrating an image forming apparatus according to an embodiment.

FIG. 4 is a schematic diagram illustrating an overview of an image forming apparatus 10 according to the present embodiment. In the subsequent drawings, the letters Y, M, C, and K appended to reference numerals indicate that the processing targets in question are yellow (Y), magenta (M), cyan (C), and black (K). Note also that in the following descriptions, reference numerals without letters appended thereto will be used in the case where it is not necessary to distinguish between different colors. A charging unit 23 charges a photosensitive member 22 that is rotationally driven, and an exposure unit 24 scans the surface of the charged photosensitive member 22 with light in order to form an electrostatic latent image thereon. Note that the exposure unit 24 includes the aforementioned lens array optical system. A developing unit 26 develops the electrostatic latent image on the photosensitive member 22 into a visual image using developer. A receptacle 25 supplies the developing unit 26 with the developer. A developer image formed on each photosensitive member 22 is transferred onto an intermediate transfer member 27 that is rotationally driven. At this time, the developer images of each color formed on the corresponding photosensitive members 22 are transferred onto the intermediate transfer member 27 in a superimposed manner, forming a multicolor developer image on the intermediate transfer member 27 as a result. The developer image transferred onto the intermediate transfer member 27 is then transferred by a transfer roller 28 onto a recording material transported along a conveyance path 11. Note that developer remaining on the intermediate transfer member 27 without being transferred onto the recording material is removed by a cleaning unit 29. A fixing unit 30 fixes the developer image onto the recording material. After the developer image has been fixed by the fixing unit 30, the recording material is discharged to the exterior of the apparatus. Note that the image forming apparatus may transfer the developer image from the photosensitive member 22 onto the recording material directly instead of using the intermediate transfer member 27.

Figure 5:
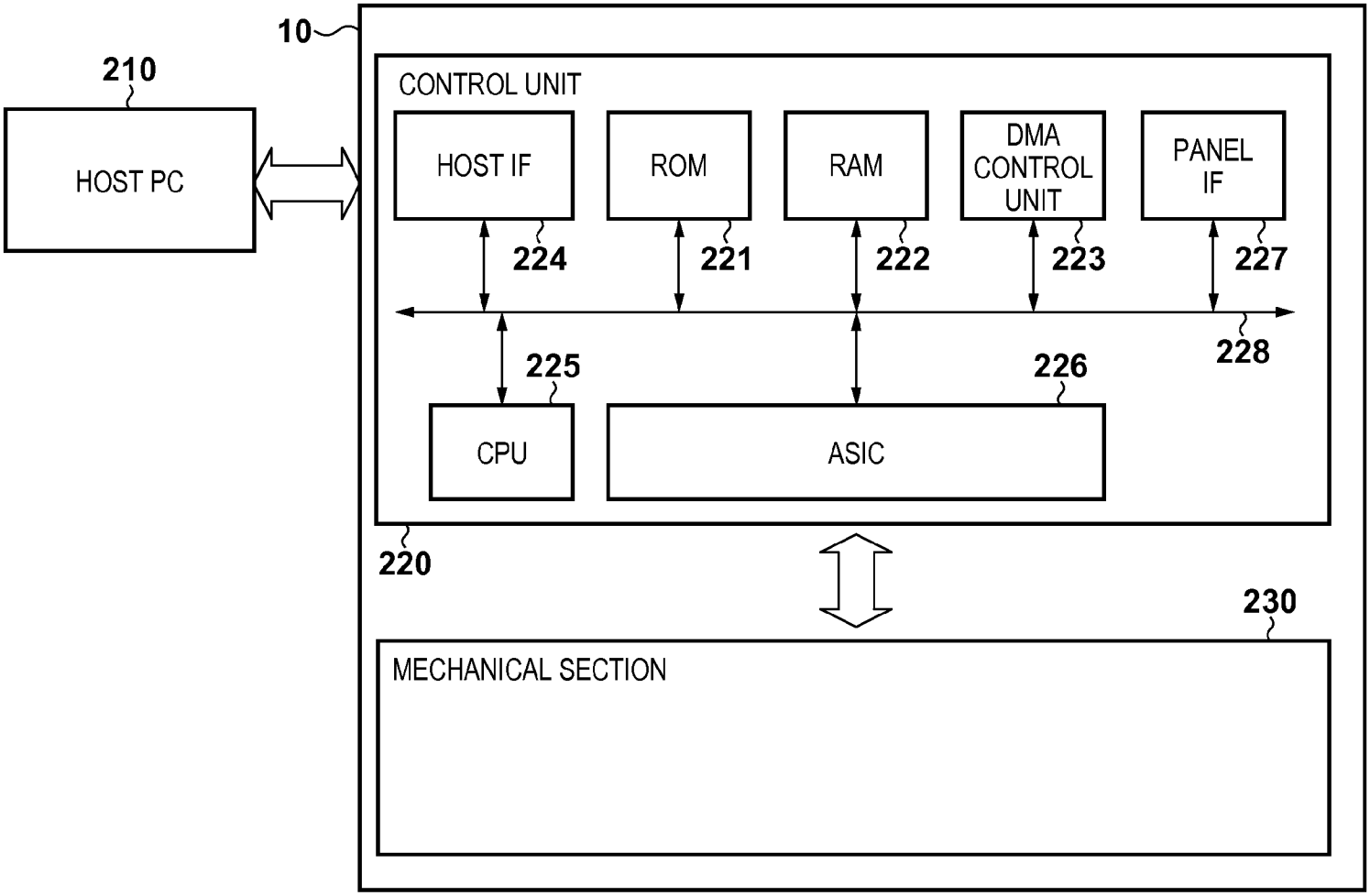
FIG. 5 is a diagram illustrating a control configuration in an image forming apparatus according to an embodiment.

FIG. 5 is a block diagram illustrating a control system in the image forming apparatus 10. A host PC 210 sends PDL (Page Description Language) data to the image forming apparatus 10. The PDL data includes rendering data, which is image data expressing an image to be formed, as well as control data for controlling image forming operations using the rendering data. The image forming apparatus 10 is broadly divided into a control unit 220 and a mechanical section 230. The mechanical section 230 carries out processing from the forming of the developer image on the photosensitive member 22 to the fixing of the image onto the recording material, handles the conveyance control of the recording material, and so on, as described above with reference to FIG. 4. The control unit 220 controls the mechanical section 230. In the control unit 220, a CPU 225 uses a RAM 222 as a main memory and a work area. The mechanical section 230 is controlled by the CPU 225 reading out various types of control programs stored in the ROM 221 into the RAM 222 and executing the programs. A system bus 228 includes an address bus and a data bus. The various constituent elements in the control unit 220 are connected to the system bus 228, and can therefore access other constituent elements via the system bus 228. A host interface (IF) unit 224 is an interface for inputting/outputting rendering data and control data to/from the host PC 210. The rendering data, received in a compressed state by the host IF unit 224, is stored in the RAM 222. The CPU 225 decompresses this compressed rendering data in the RAM 222 and stores the decompressed rendering data in the RAM 222. A DMA control unit 223 transfers the rendering data in the RAM 222 to an ASIC 226 in response to an instruction from the CPU 225. A panel IF unit 227 is an interface that receives settings and instructions input by a user through a display panel unit provided in the image forming apparatus 10, from that display panel unit.

The CPU 225 and the ASIC 226 control the mechanical section 230 based on the control data and the rendering data input via the host IF unit 224. Note that the functions of the CPU 225 may be partially or entirely implemented by the ASIC 226, and conversely, the functions of the ASIC 226 may be partially or entirely implemented by the CPU 225. Furthermore, dedicated hardware may be provided separately from the image forming apparatus 10, and the functions of the CPU 225 and the ASIC 226 may be partially implemented by that dedicated hardware.

Next, processing carried out in the image forming apparatus will be described with reference to FIG. 6A. A renderer 303 realized by the CPU 225 decompresses the compressed data contained in the PDL data received from the host PC 210 into the rendering data and stores the rendering data in the RAM 222. Note that in the present embodiment, density data in the rendering data is data indicating R (red), G (green) and B (blue) tone values expressed using the RGB color space.

The rendering data stored in the RAM 222 is sent pixel-by-pixel in raster order to the ASIC 226 under the control of the DMA control unit 223. Meanwhile, a control information generating unit 304 realized by the CPU 225 sends the control information contained in the PDL data to the ASIC 226, and further obtains control information required for processes executed by the ASIC 226 from the ROM 221 and sends that information to the ASIC 226. Note that the control information held in the ROM 221 includes a color conversion table, a gamma correction table, a halftone table, the ghost light profile, a delay table, and the like, for example.

The control information received by the ASIC 226 is then supplied to a color conversion processing unit 305, a gamma correction unit 306, a halftone processing unit 307, a delay processing unit 309, and a ghost light processing unit 308. The rendering data received by the ASIC 226 is supplied to the color conversion processing unit 305. The color conversion processing unit 305 converts an input signal configured of the R, G, and B tone values into tone values (pixel values) expressed in the CMYK color space, namely C, M, Y, and K values. The color conversion processing unit 305 furthermore outputs the C, M, Y, and K tone values to the gamma correction unit 306. Using the gamma correction table contained in the control information, the gamma correction unit 306 generates tone values C', M', Y', and K' by correcting the tone values C, M, Y, and K, and outputs the corrected tone values to the halftone processing unit 307.

Using the halftone table contained in the control information, the halftone processing unit 307 converts the tone values C', M', Y', and K' into tone values C", M", Y", and K" by carrying out a halftone process, and outputs the converted tone values to the delay processing unit 309. Using the delay table contained in the control information, the delay processing unit 309 carries out a delay process, generating delayed tone values C'", M'", Y'", and K'" from the tone values C", M", Y", and K", and outputs the delayed tone values to the ghost light processing unit 308. Note that the RAM 222 is used as an image buffer required by the delay process. Using the ghost light profile in the control information, the ghost light processing unit 308 carries out a ghost light correction process, and generates post-ghost light correction process tone values C"", M"", Y"", and K"" from the tone values C'", M'", Y'", and K'". The corrected tone values that have been generated are then output to the exposure unit 24. Details of the ghost light correction process will be given later.

Figure 6A:
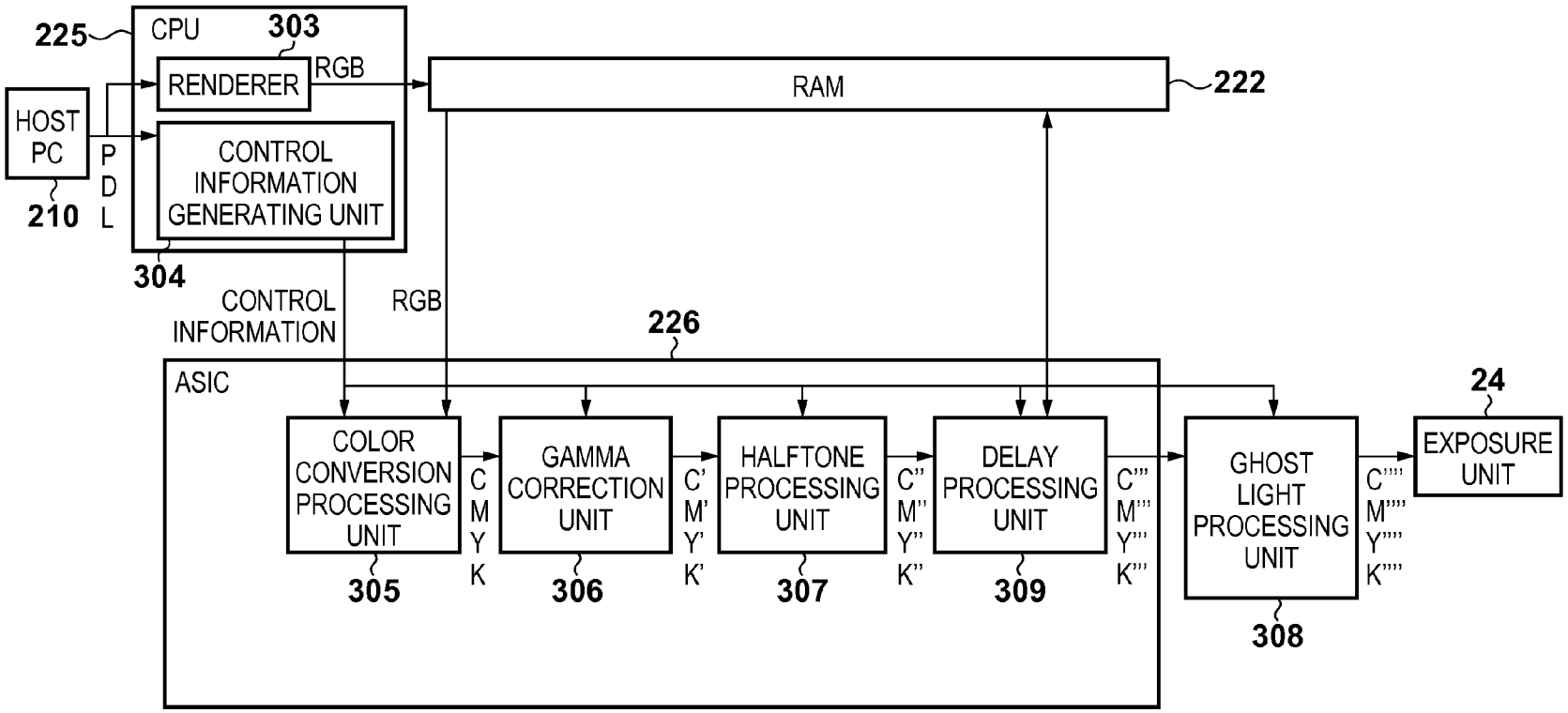
FIGS. 6A and 6B are diagrams illustrating an image processing configuration for image forming according to an embodiment.
Figure 6B:
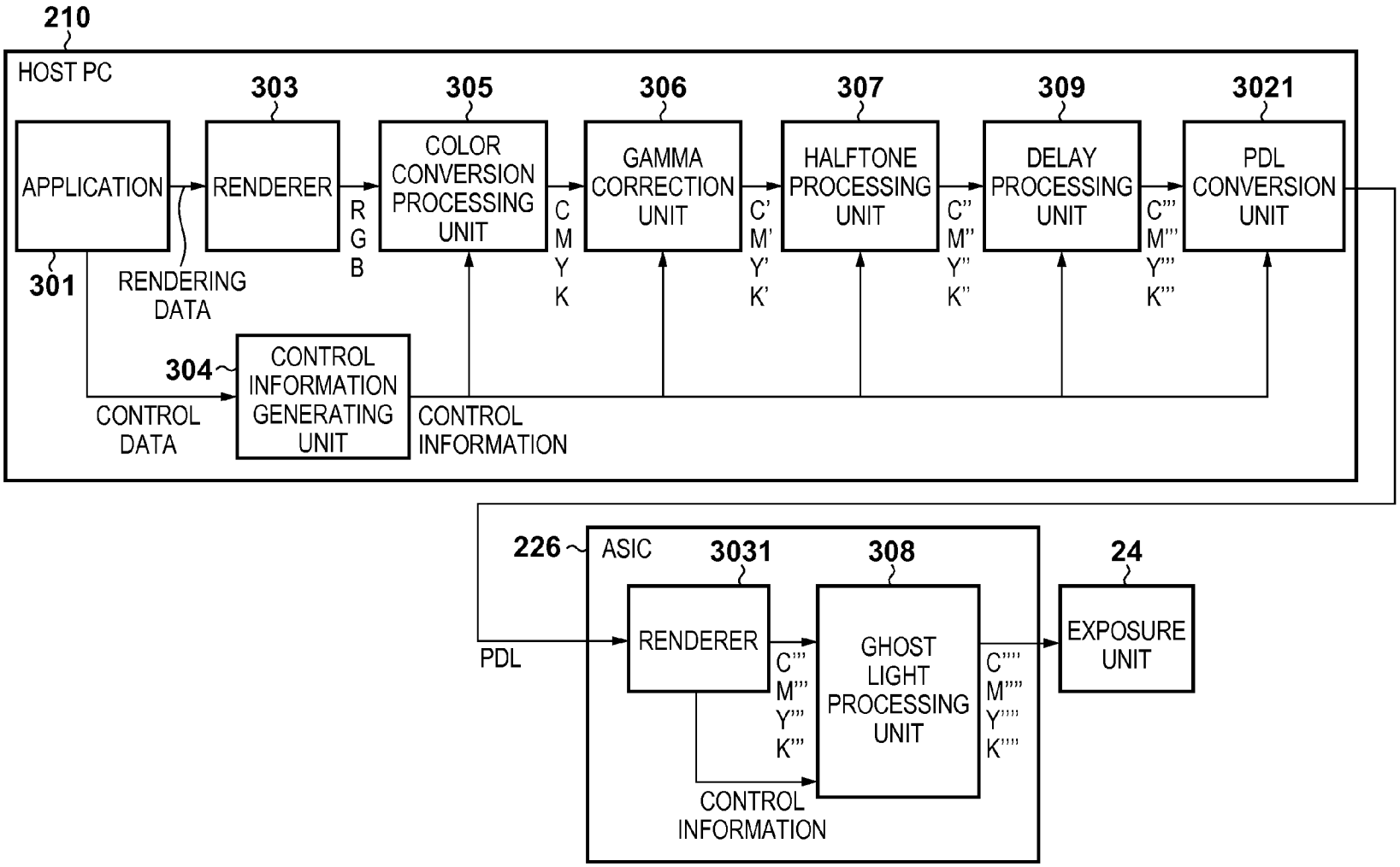

The processing performed by the ASIC 226 shown in FIG. 6A can also be implemented on the host PC 210 side, as shown in FIG. 6B. In FIG. 6B, an application 301 outputs the rendering data to the renderer 303 and outputs the control data to the control information generating unit 304. Meanwhile, a PDL conversion unit 3021 has a function for converting the delayed tone values C'", M'", Y'", and K'" output by the delay processing unit 309, and the control information, into rendering data and control data, which together serve as the PDL data. The PDL data is then sent to the ASIC 226 in the image forming apparatus 10. In the ASIC 226, a renderer 3031 converts the PDL data received from the host PC 210 into the tone values C'", M'", Y'", and K'" and the control information, and outputs the result to the ghost light processing unit 308. Although the rendering data stored in the RAM 222 is sent to the ASIC 226 one pixel at a time in the configuration shown in FIGS. 6A and 6B, a plurality of pixels in the rendering data may be sent simultaneously in order to increase the sending speed, the processing speed, and so on.

Figure 7:
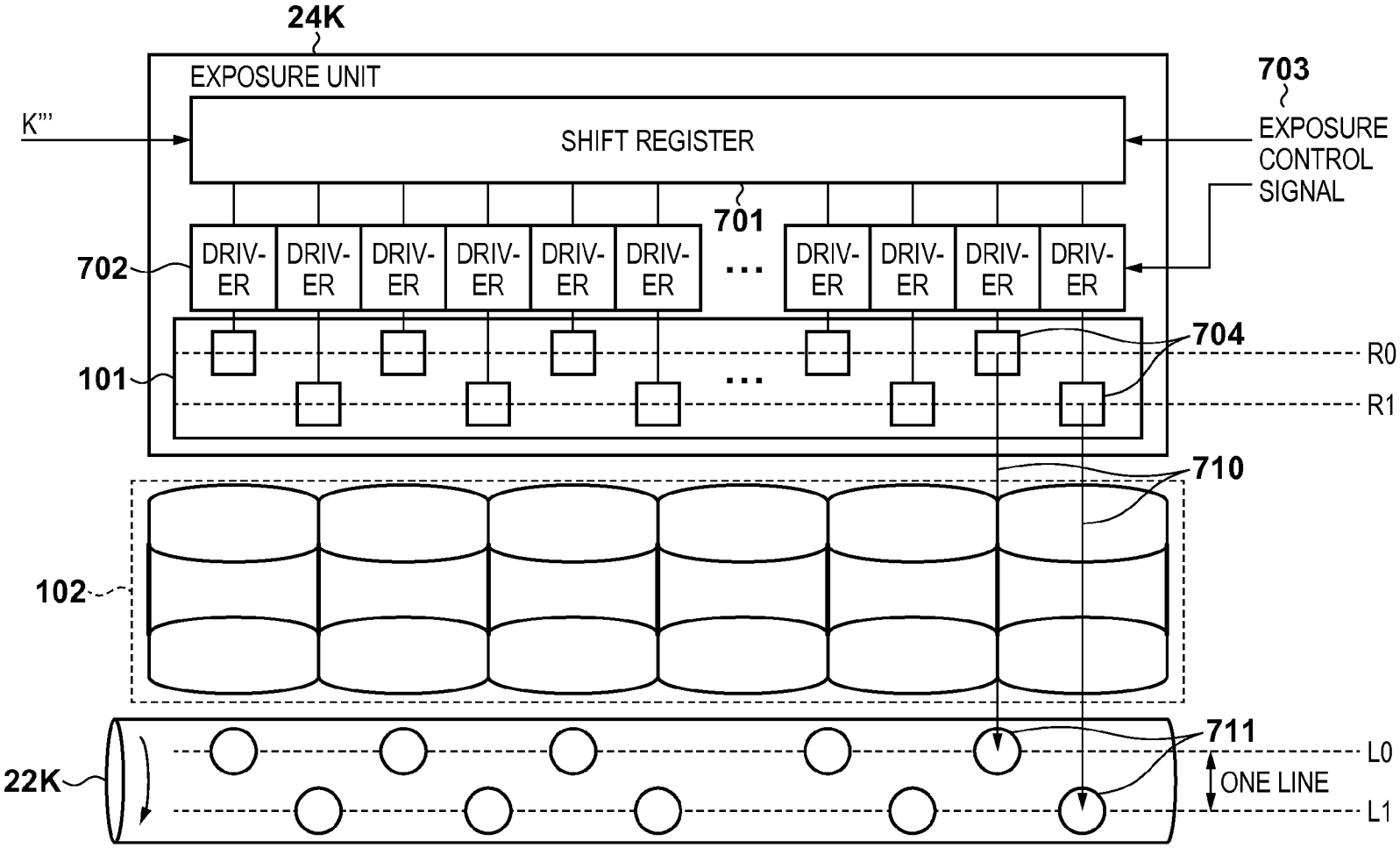
FIG. 7 is a block diagram illustrating an exposure unit according to an embodiment.

FIG. 7 is a block diagram illustrating the exposure unit 24K according to the present embodiment. Note that the exposure units 24Y, 24M, and 24C are the same. Furthermore, L=2 in the light source unit 101 of the present embodiment, as indicated in FIG. 3A. A shift register 701 holds tone values K"" for the pixels corresponding to a single line, in a main scanning direction, of the latent image formed on the photosensitive member 22K. The shift register 701 outputs the tone value K"" from each pixel to a corresponding driver 702. Each driver 702 drives the light-emitting unit 704 corresponding to each pixel in the light source unit 101, and outputs a current at a current level that is based on the tone value K"" input from the shift register 701. A light flux emitted from each light-emitting unit 704 traverses the lens array optical system 102 and forms, on the photosensitive member 22K, an image at a pixel (an image point) 711 corresponding to that light-emitting unit 704. In the present embodiment, the light-emitting units 704 are disposed in L=2 columns, and thus the light-emitting units 704 in different columns are configured to form images on the photosensitive member 22K so that the respective lines are shifted, as indicated by reference numeral 710 in FIG. 7. Hereinafter, an image forming point 711 that is in a first scanning line on the upstream side in the rotational direction of the photosensitive member 22K is indicated by L0, and an image forming point 711 that is in a second scanning line on the downstream side is indicated by L1. Furthermore, a light-emitting unit 704 corresponding to L0 is indicated by R0, and a light-emitting unit 704 corresponding to L1 is indicated by R1. As shown in FIG. 7, the exposure unit 24K according to the present embodiment exposes half of the pixels in two scanning lines on the photosensitive member 22K at the same time. Although L=2 in the present embodiment, it should be noted that the exposure unit 24K generally exposes the pixels every L number of pixels in L scanning lines on the photosensitive member 22K at the same time.

Next, the delay processing unit 309 will be described using FIGS. 8A to 8C. Although the following describes processing performed on black (K) rendering data, it should be noted that the same applies to the other colors as well. As described earlier, the light-emitting units 704 in the exposure unit 24K are in this example disposed in two columns, and are configured so that images are formed on the photosensitive member 22K so as to be shifted by one line from column to column. The order of the pixels in the rendering data is the same as the order of the pixels in the scanning lines, and it is thus necessary to switch the arrangement of the tone values to accommodate the configuration of the light source unit 101 before setting the tone values in the shift register 701 of the exposure unit 24. The delay processing unit 309 switches the order of the tone values to accommodate the configuration of the light source unit 101 in this manner.

Figures 8A, 8B, 8C:
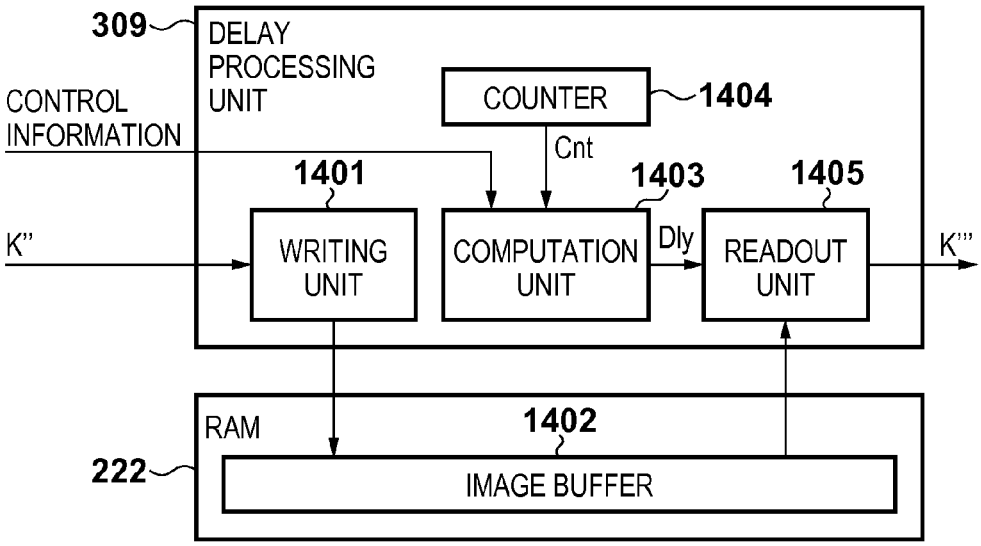
FIGS. 8A to 8C are diagrams illustrating a delay processing unit according to an embodiment.

FIG. 8A illustrates 5,000 dots×3 lines of rendering data. In FIG. 8A, the letters A, B, and C indicate different scanning lines, and the subscript numbers indicate the positions of pixels in the same scanning line. The delay processing unit 309 rearranges the rendering data in FIG. 8A into the order shown in FIG. 8B and outputs the resulting data. Note that a tone value of 0 is allocated to the blank dots in FIG. 8B. In FIG. 8B, the positions of the rendering data corresponding to the light-emitting units 704 that are indicated by R1 in FIG. 7 are delayed by a single line. When the photosensitive member 22K rotates by one line, the image forming points 711 that are indicated by L0 fall on the same line as the image forming points indicated by L1, and thus by delaying the rendering data as shown in FIG. 8B, the proper positions can be exposed with the proper tone values.

Figures 9A, 9B:
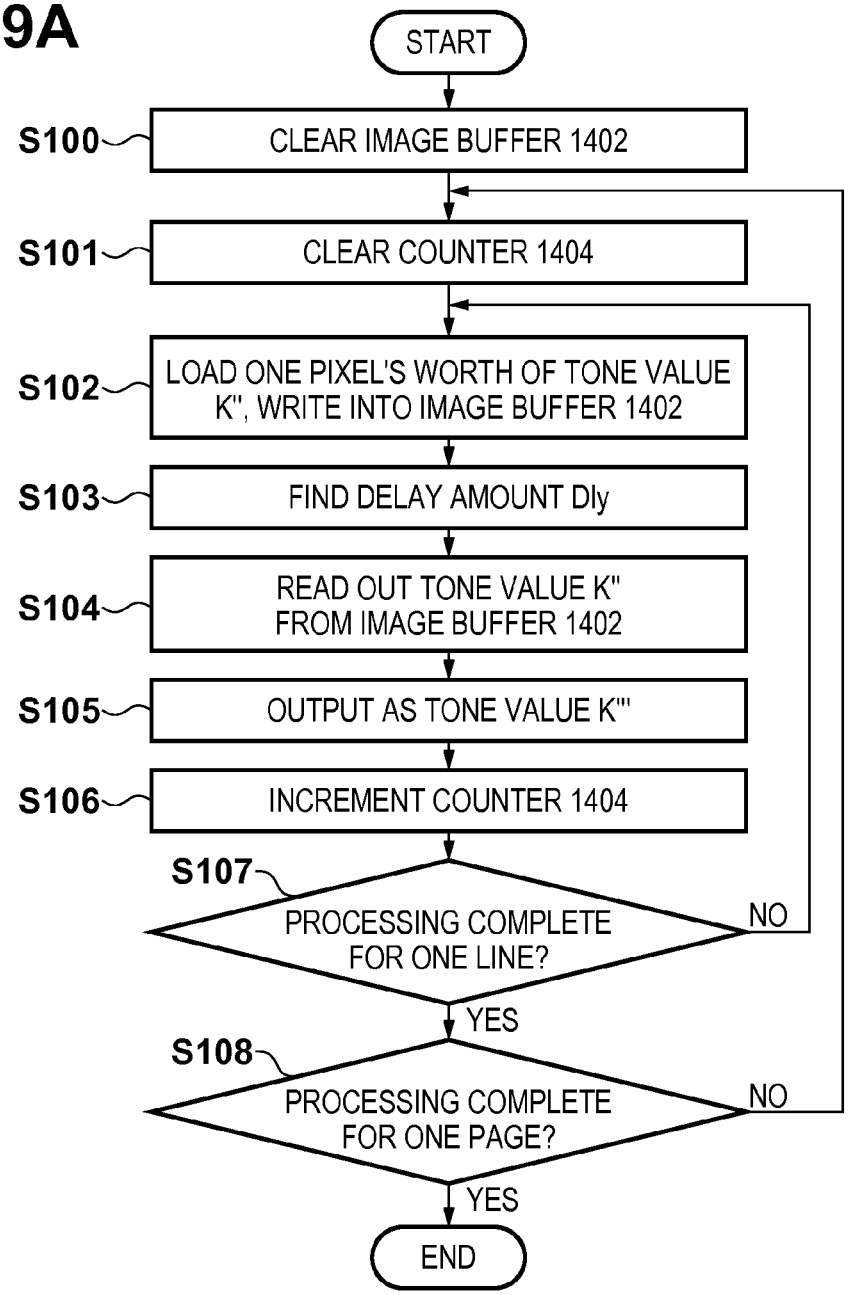
FIGS. 9A and 9B are flowcharts illustrating a delay process according to an embodiment.

FIG. 8C is a block diagram illustrating an example of the delay processing unit 309. Operations performed by the delay processing unit 309 will be described using the flowchart in FIG. 9A. First, in S100, the delay processing unit 309 clears an image buffer 1402, and in S101, clears a counter 1404. Then, in S102, a writing unit 1401 loads one pixel's worth of the tone value K", and writes that value into the image buffer 1402. Then, in S103, a computation unit 1403 determines a delay amount Dly based on a counter value Cnt of the counter 1404. Note that the computation unit 1403 determines the delay amount Dly by referring to the delay table contained in the control information. FIG. 9B illustrates an example of the delay table. The delay table shown in FIG. 9B indicates that when the counter value Cnt is an even number, the delay amount Dly is set to 0, and when the counter value Cnt is an odd number, the delay amount Dly is set to 1.

Next, in S104, a readout unit 1405 reads out the tone value K" from the image buffer 1402 based on the delay amount Dly. Note that in the case where the delay amount Dly is 0, the tone value K" written into the image buffer 1402 is the most recent S102 is read out, whereas in the case where the delay amount Dly is 1, the tone value K" written into the image buffer 1402 when the processing for the previous line was carried out is read out. In S105, the readout unit 1405 outputs the tone value K" read out in S104 as the tone value K'''. Thereafter, in S106, the delay processing unit 309 increments the counter value Cnt of the counter 1404 by 1, and in S107 determines whether the processing for a single line has been completed. If the processing for a single line has not been completed, the processing is repeated from S102, whereas if the processing for a single line has been completed, it is determined in S108 if the processing has been completed for a single page. If the processing for a single page has not been completed, the processing is repeated from S101, whereas if the processing for a single page has been completed, the delay process ends. Note that the delay process can be implemented at a low cost by using the RAM 222 as the image buffer 1402, as shown in FIG. 8C. On the other hand, it is necessary to provide the image buffer 1402 in the exposure unit 24 in order to carry out the delay process after the ghost light processing has been carried out, which increases costs.

Figure 10A:
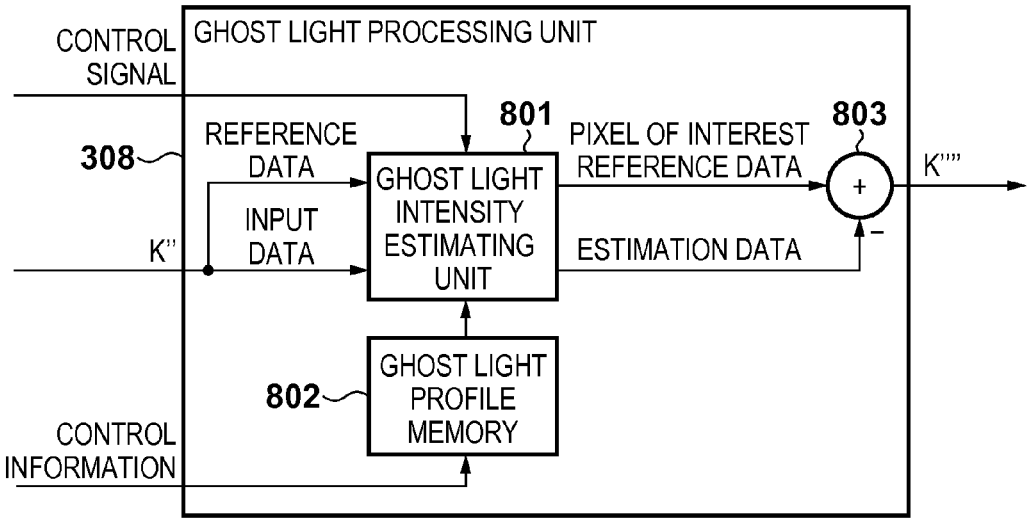
FIGS. 10A and 10B are block diagrams illustrating a ghost light processing unit according to an embodiment.

FIG. 10A is a block diagram illustrating the ghost light processing unit 308 according to the present embodiment. Although a ghost light correction process for black will be described here, the same applies to the other colors as well. In FIG. 10A, the ghost light processing unit 308 includes a ghost light intensity estimating unit 801, a ghost light profile memory 802, and an adder 803. The ghost light intensity estimating unit 801 reads out the ghost light profile from the ghost light profile memory 802, and based on the input data, estimates the intensity of ghost light produced at the position of a pixel of interest on the photosensitive member 22K by the light-emitting units 704 corresponding to the pixels in the periphery of the pixel of interest. The ghost light intensity estimating unit 801 then converts the ghost light intensity at the position of the pixel of interest to a tone value and outputs the result as estimation data along with reference data indicating the pixel of interest.

The ghost light profile memory 802 stores the ghost light profile contained in the control information. Note that as described above, the ghost light profile is information indicating a relationship between the light emitted from a light-emitting unit corresponding to a pixel in a different predetermined positional relationship with the pixel of interest, and the ghost light produced at the position of the pixel of interest on the photosensitive member by that light. The adder 803 subtracts the ghost light intensity estimation data from the reference data of the pixel of interest and outputs the result as the post-ghost light correction process tone value K''''. In this manner, the present embodiment suppresses the influence of the ghost light on the pixel of interest by subtracting, from the tone value K''' of the pixel of interest, an estimated value of the intensity of the ghost light produced at the pixel of interest by the light-emitting units 704 corresponding to the pixels in the periphery of the pixel of interest. In other words, the ghost light intensity estimating unit 801 and the adder 803 configure a correcting unit that estimates the intensity of the ghost light and corrects the tone value. By carrying out the same processing on the tone values K''' for all of the input pixels, the influence of the ghost light on all of the pixels can be suppressed. The units will be described in greater detail below.

Figure 10B:
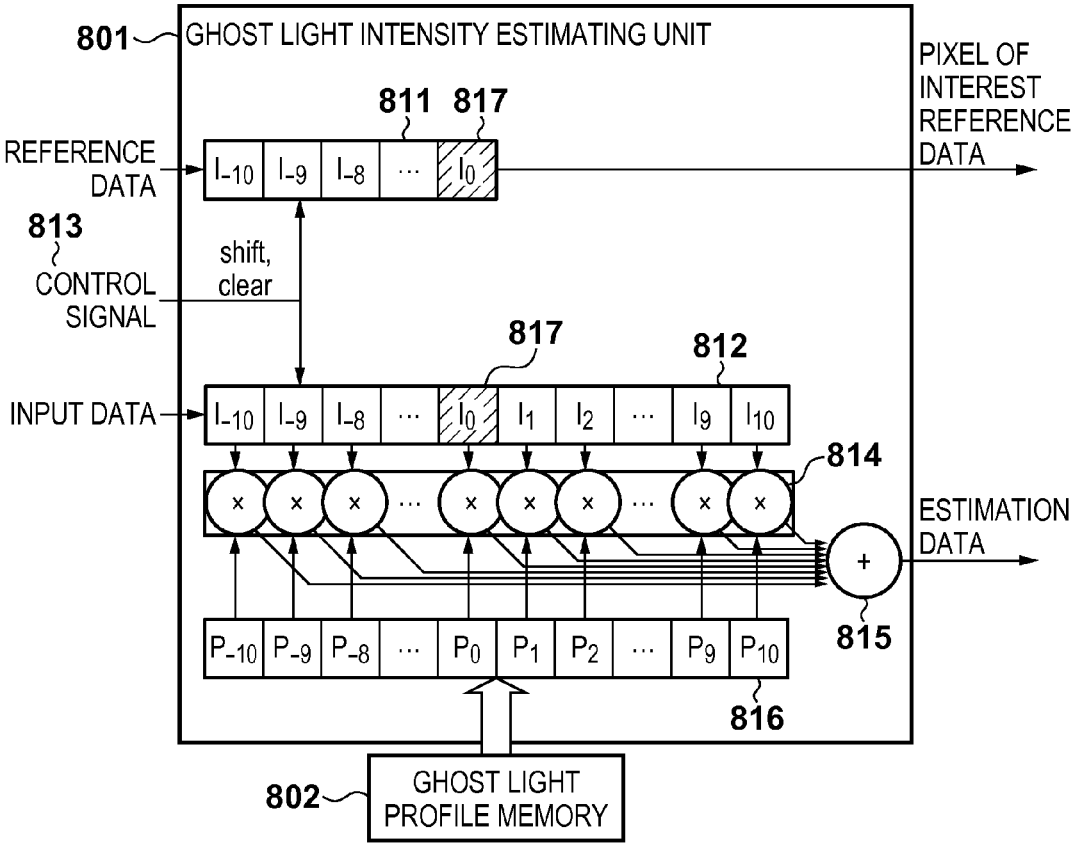
Figure 11:
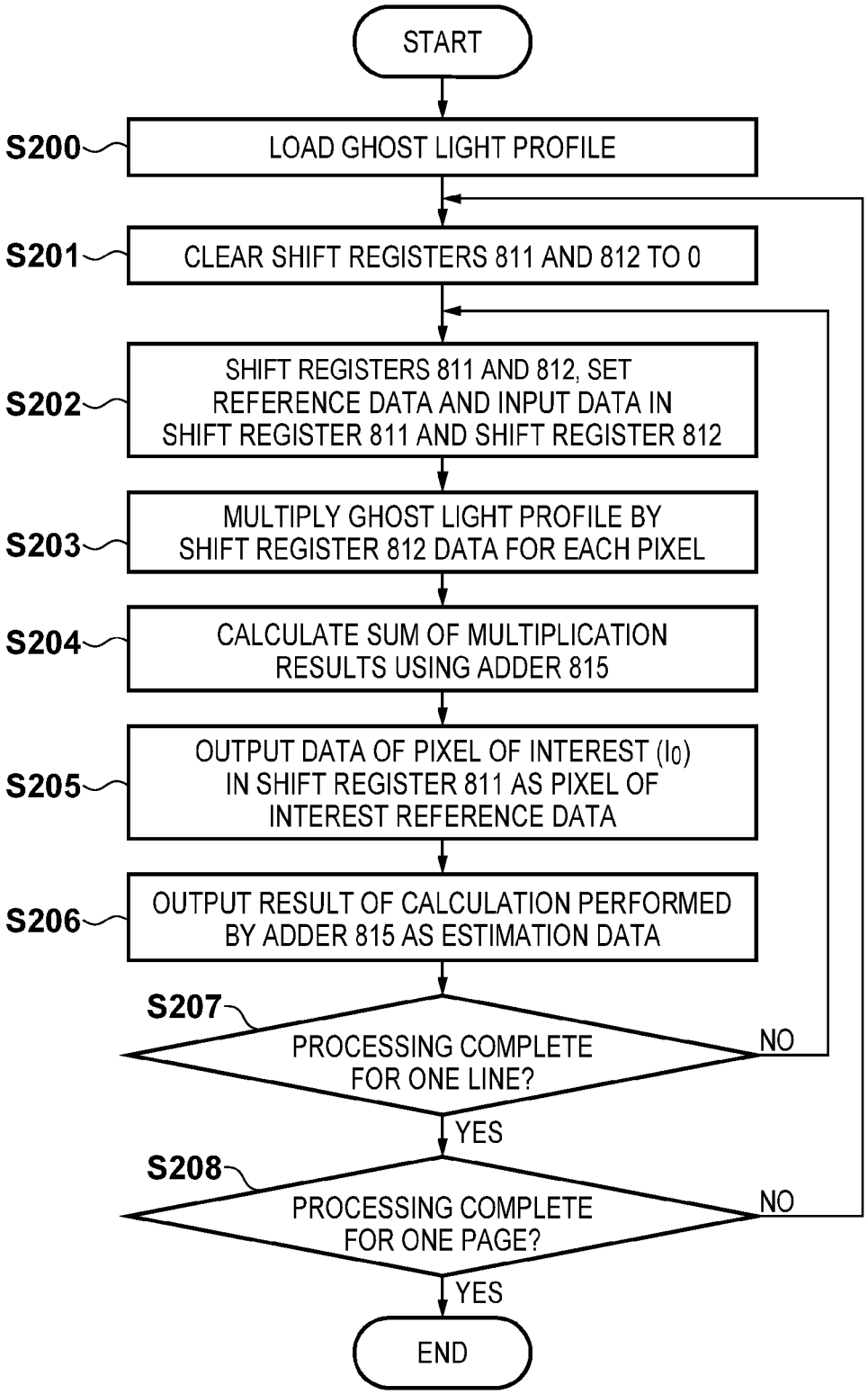
FIG. 11 is a flowchart illustrating a correction process performed by the ghost light processing unit according to an embodiment.

FIG. 10B is a block diagram illustrating the ghost light intensity estimating unit 801. Operations performed by the ghost light intensity estimating unit 801 will be described hereinafter using the flowchart shown in FIG. 11. First, in S200, the ghost light intensity estimating unit 801 loads the ghost light profile described using FIG. 2B from the ghost light profile memory 802 into a register 816. Note that the profile may be loaded directly from the ROM 221 or the like without using the ghost light profile memory 802. The data of the pixel of interest 1001 is written into a position P0 in the register 816. Although the present embodiment discusses a ghost light profile corresponding to 21 pixels, a ghost light profile having any number of pixels can be used. Next, in S201, the respective register values in a shift register 811 and a shift register 812 are reset to 0 in response to a control signal 813 from the ASIC 226 indicating a "clear" operation. The shift register 812 holds input data, and the size thereof is the same as the number of pixels in the ghost light profile. The shift register 811 also holds the reference data, whose size is the same as the number of pixels from a left end of the ghost light profile to the position of the pixel of interest 1001, or in other words, is 11 pixels in the present embodiment. The positions in the shift register 811 and the shift register 812 that correspond to the pixel of interest are positions $I_0$, indicated by reference numeral 817 in FIG. 10B.

Next, in S202, the shift register 811 and the shift register 812 shift to the right in response to a control signal 813 from the ASIC 226 indicating a shift operation, and the reference data is set in the shift register 811 and the input data is set in the shift register 812. Note that the data input one pixel at a time in raster order is shifted in order to the right, and thus the shift register 811 and the shift register 812 hold data in which the original data has been inverted horizontally.

Next, in S203, a multiplier array 814 multiplies the ghost light profile in the register 816 by the data in the shift register 812 on a pixel-by-pixel basis. As described above, the ghost light profile expresses a percentage of ghost light irradiated at the position of the pixel of interest on the photosensitive member 22K by the light-emitting units 704 corresponding to the pixel in the periphery of the pixel of interest. The shift register 812 holds the tone values of the pixel of interest 817 and the periphery of the pixel of interest, and thus the result of the multiplication corresponds to the intensity of the ghost light irradiated at the position of the pixel of interest on the photosensitive member 22K from the light-emitting units 704 of the respective pixels. Then, in S204, an adder 815 calculates a sum of the multiplication results from the multiplier array 814. The sum of the multiplication results corresponds to a total value of the intensity of the ghost light irradiated at the position of the pixel of interest on the photosensitive member 22K.

The ghost light intensity estimating unit 801 outputs the tone value of the pixel of interest $I_0$ in the shift register 811 as pixel of interest reference data in S205, and outputs the result of the calculation performed by the adder 815 as the estimation data, which is values obtained by converting the ghost light at the pixel of interest into tone values, in S206. Next, in S207, the ghost light intensity estimating unit 801 determines whether one line's worth of processing is complete, and repeats the processing from step S202 in the case where the one line's worth of processing is not complete. On the other hand, in the case where the one line's worth of processing is complete, it is determined in S208 whether one page's worth of processing is complete, and the processing is repeated from S201 in the case where the one page's worth of processing is not complete. The operations performed by the ghost light intensity estimating unit 801 ends in the case where the one page's worth of processing is complete.

Figure 12A:
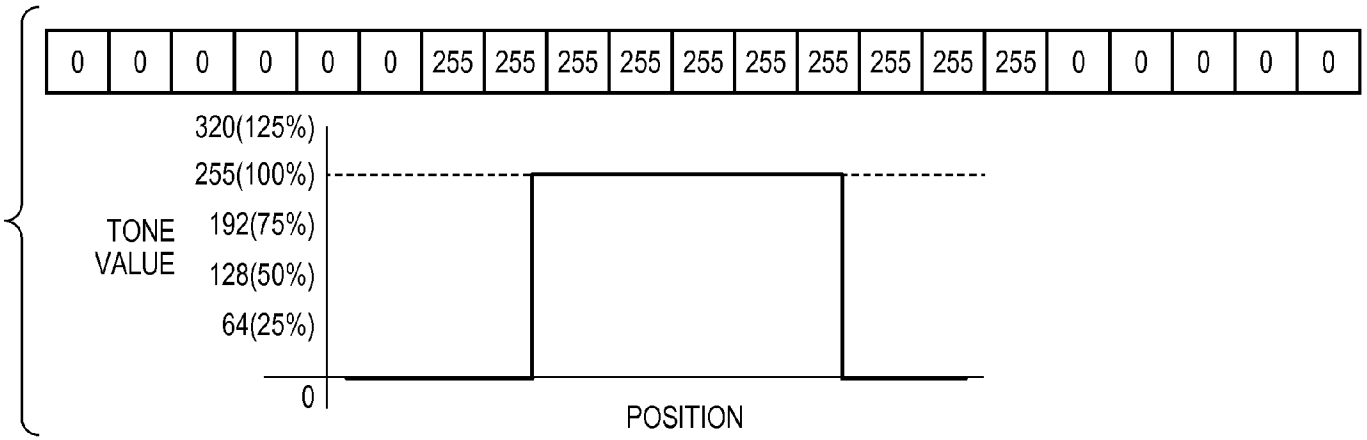
FIGS. 12A and 12B are diagrams illustrating rendering data and an exposure intensity occurring in the case where a photosensitive member is exposed according to the rendering data, according to an embodiment.
Figure 12B:
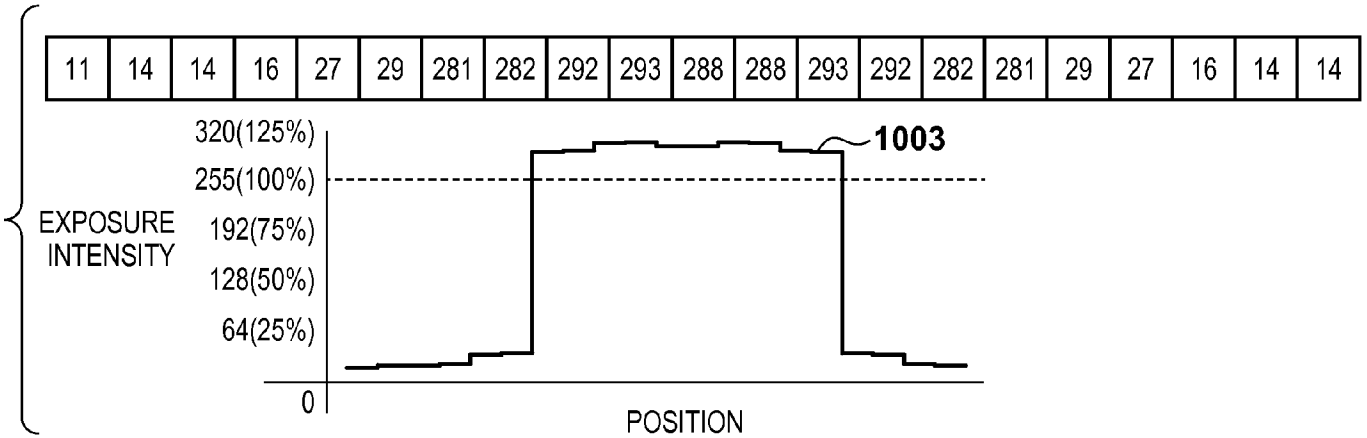

FIG. 12A illustrates rendering data, in which the values of 10 consecutive pixels in a single line are 255 and the values of the other pixels in the same line are 0. FIG. 12B, meanwhile, indicates the exposure intensity of a single scanning line on the photosensitive member 22 in the case where the photosensitive member 22 has been exposed by a conventional exposure unit having a lens array optical system using the rendering data shown in FIG. 12A. Note that the "conventional exposure unit having a lens array optical system" refers to a unit in which there is a single column of light-emitting units 704 in the light source unit 101, or in other words, in which L=1, and light-emitting units 704 corresponding to the respective pixels in a single scanning line carry out exposure simultaneously. The exposure intensity shown in FIG. 12B is calculated assuming the ghost light characteristics are as shown in FIG. 2A. As shown in FIG. 12B, the values obtained by converting the exposure intensity at the photosensitive member 22 into tone values are greater than the tone values shown in FIG. 12A, due to the influence of ghost light.

Figure 13A:
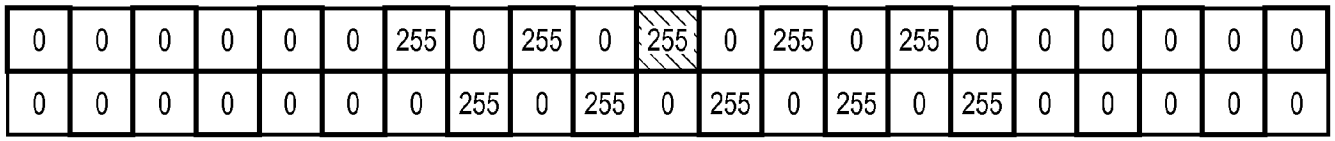
FIGS. 13A and 13B are diagrams illustrating a correction process according to an embodiment.
Figure 13B:
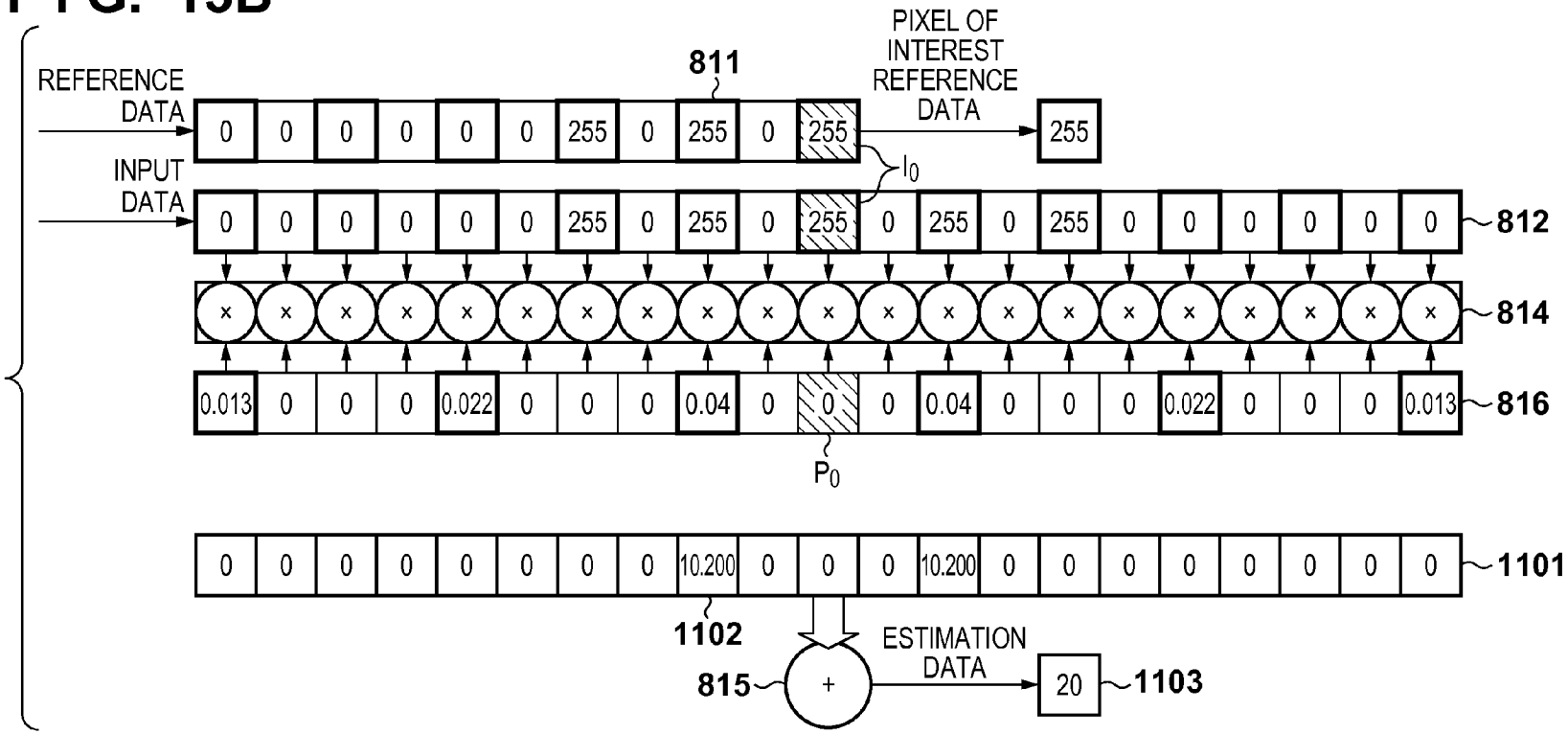

FIG. 13A illustrates data obtained after the delay processing unit 309 has carried out the delay process on the rendering data shown in FIG. 12A. Meanwhile, FIG. 13B illustrates a state in which the rendering data shown in FIG. 13A has been loaded into the shift register 811 and the shift register 812 of the ghost light intensity estimating unit 801. From FIG. 13B, it can be seen that the rendering data shown in FIG. 12A and rendering data from other scanning lines have been loaded into the shift register 811 and the shift register 812 in a mixed state. Note that the bold frames in FIGS. 13A and 13B indicate data corresponding to the rendering data shown in FIG. 12A. Meanwhile, the ghost light profile shown in FIG. 2B is loaded into the register 816 in FIG. 13B.

Furthermore, reference numeral 1101 in FIG. 12B indicates a result of the multiplier array 814 multiplying the data in the register 816 and the shift register 812, whereas reference numeral 1103 indicates values obtained by converting the ghost light estimated intensities output by the adder 815 into tone values. For example, reference numeral 1102 indicates that a result of multiplying a tone value 255 in the shift register 812 by a ghost light profile value of 0.04 for the corresponding pixel, or in other words, 10.200, will be output from the multiplier array 814. In the present example, L=2 and n=1, and rendering data of scanning lines different from those in the rendering data $I_0$ of the pixel of interest is also loaded into the shift register 812. However, the ghost light profile has only values for the light-emitting unit 704 corresponding to the pixels in the same scanning line as the pixel of interest $I_0$, and all other values are 0. Accordingly, the intensity of the ghost light produced at the pixel of interest can be calculated properly even if the rendering data of a scanning line that is different from the rendering data $I_0$ of the pixel of interest is loaded into the shift register 812. In the present example, the design is such that L=2 and n=1, and the ghost light has peaks every four dots. However, the present invention is not limited to this example, and the design may be such that the intensity increases every multiple of four dots, such as every eight dots, every twelve dots, and so on. Even in such a case, the pixels corresponding to the peaks in the intensity of the ghost light profile are pixels located in the same scanning line as the pixel of interest, and thus the intensity of the ghost light at the pixel of interest can be calculated accurately. In other words, any desired integer can be used for n.

Figure 14A:
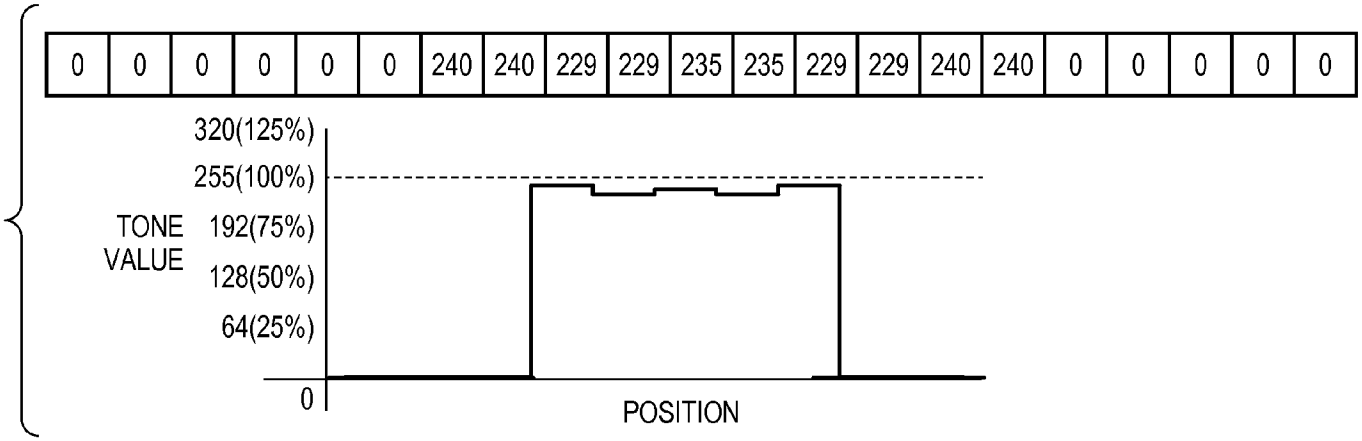
FIGS. 14A and 14B are diagrams illustrating corrected rendering data and an exposure intensity occurring in the case where a photosensitive member is exposed according to the corrected rendering data, according to an embodiment.
Figure 14B:
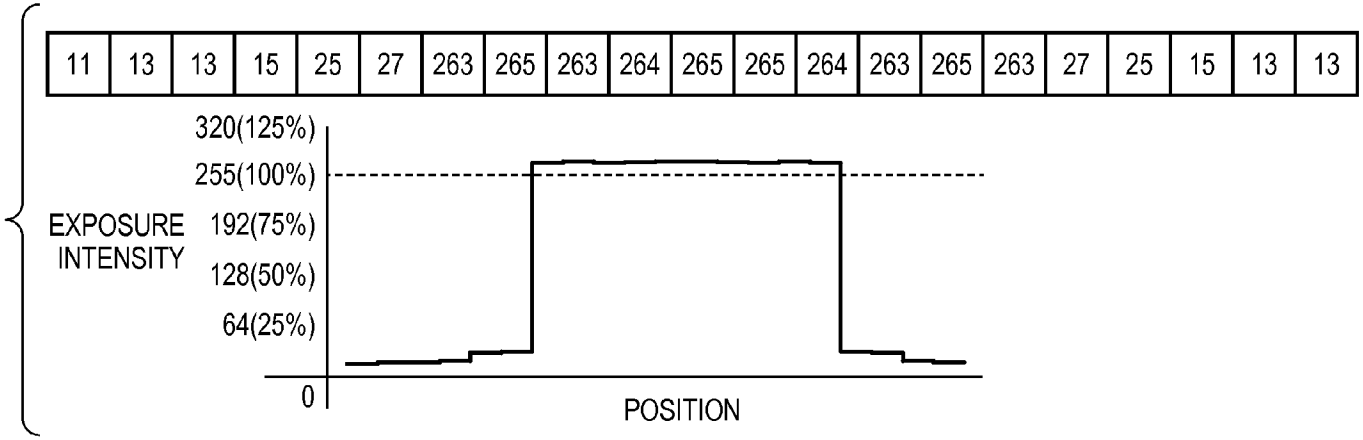

FIG. 14A illustrates corrected tone values K"" obtained as a result of calculations performed by the delay processing unit 309 and the ghost light processing unit 308 in the case where the tone values K" of the rendering data shown in FIG. 12A are employed. Note that the effects of the image delay are not shown, or in other words, only the tone values of the pixels of a single scanning line are shown, in order to make a comparison with FIG. 12A easier. The respective tone values shown in FIG. 14A are lower than the tone values shown in FIG. 12A by an amount equivalent to the produced ghost light. FIG. 14B, meanwhile, illustrates an exposure intensity distribution at the photosensitive member 22K in the case where the photosensitive member 22K has been exposed by the exposure unit 24K according to the rendering data shown in FIG. 14A. Compared to FIG. 12B, can be seen that the influence of the ghost light has been suppressed, and the photosensitive member 22K has been exposed at almost the same exposure intensity as that indicated by the rendering data in FIG. 12A.

As described thus far, the lens array optical system 102 is designed using light sources disposed in a plurality of columns to simultaneously expose pixels located in different scanning lines, so that an interval at which peaks occur in the ghost light is a value based on the number of columns of light sources. More specifically, the design is such that the number of columns of the light sources is an even-number multiple, with a pixel used as the unit for the interval at which the peaks occur in the ghost light. The intensity of the ghost light produced at a pixel of interest is estimated based on the ghost light peak values, and the rendering data is then corrected. According to this configuration, the influence of the ghost light can be suppressed without complicating the shape or increasing the size of a light-blocking member. Furthermore, an exposure unit that exposes a plurality of scanning lines is used, the ghost light intensity at the position of each exposed pixel is estimated from image data, and the image data is then corrected.

Second Embodiment

Figure 15:
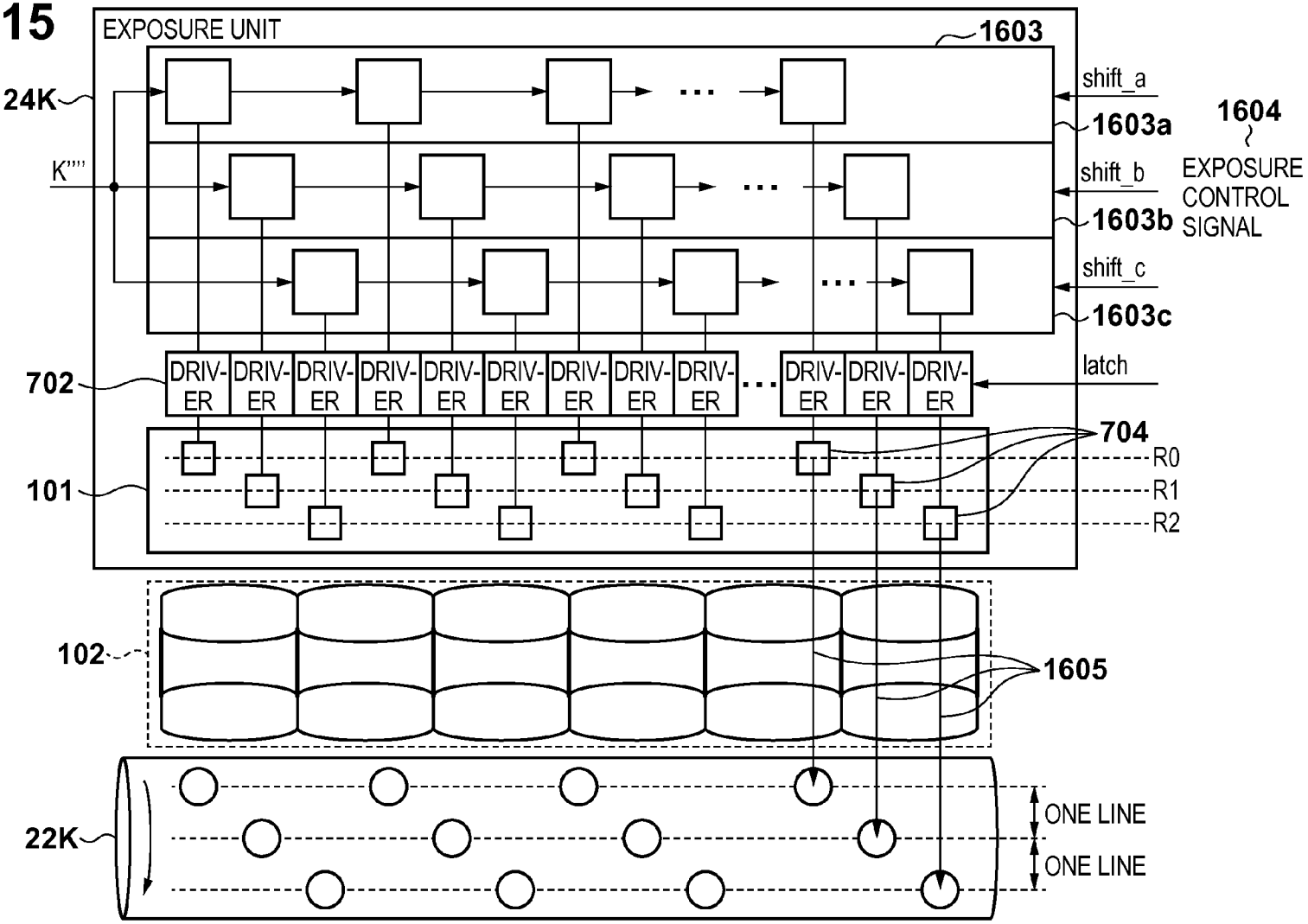
FIG. 15 is a schematic diagram illustrating an exposure unit according to an embodiment.

Although the first embodiment assumes that L=2, the present embodiment will be described assuming that L=3. FIG. 3B illustrates the light source unit 101 in the case where L=3. FIG. 15, meanwhile, illustrates the exposure unit 24K having the light source unit 101 in the case where L=3. In the present embodiment, L=3, and thus a shift register 1603 is divided into three shift registers 1603*a*, 1603*b*, and 1603*c* that correspond to scanning lines scanned simultaneously. Meanwhile, an exposure control signal 1604 includes a shift_a signal_a shift_b signal, and a shift_c signal for driving the shift registers 1603*a*, 1603*b*, and 1603*c*, respectively.

In the present embodiment, the shift register from which the tone value K"" is obtained can be switched by applying the shift_a signal, the shift_b signal, and the shift_c signal individually on a pixel-by-pixel basis. Internally dividing the shift register 1603 in this manner makes it possible to input the tone value K"" to the exposure unit 24K at a speed three times the operational speed of the individual shift registers 1603*a*, 160*b*, and 1603*c*. The light-emitting units 704 in each column are configured to form images in different scanning lines, as indicated by reference numeral 1605.

Meanwhile, the delay processing unit 309 according to the present embodiment switches the order in which the tone values K"" are input to the exposure unit 24K so that the proper tone values are applied to the light-emitting units 704 disposed in three columns. FIGS. 16A and 16B are diagrams illustrating the delay process according to the present embodiment, and the method for implementing this process is the same as that illustrated in FIGS. 8A and 8B. The delay processing unit 309 according to the present embodiment corrects skew in the image position and forms images in proper positions by changing the positions in the rendering data shown in FIG. 16A to that shown in FIG. 16B and outputting the corrected data. FIG. 16C illustrates a delay table used to convert the order of the tone values of the pixels in the rendering data shown in FIG. 16A to the order shown in FIG. 16B. Note that the delay table shown in FIG. 16C indicates that a remainder from dividing the counter value Cnt by three is taken as a delay amount. Here, delay amounts 0, 1, and 2 each indicate a number of lines by which the positions will be delayed.

Figure 17:
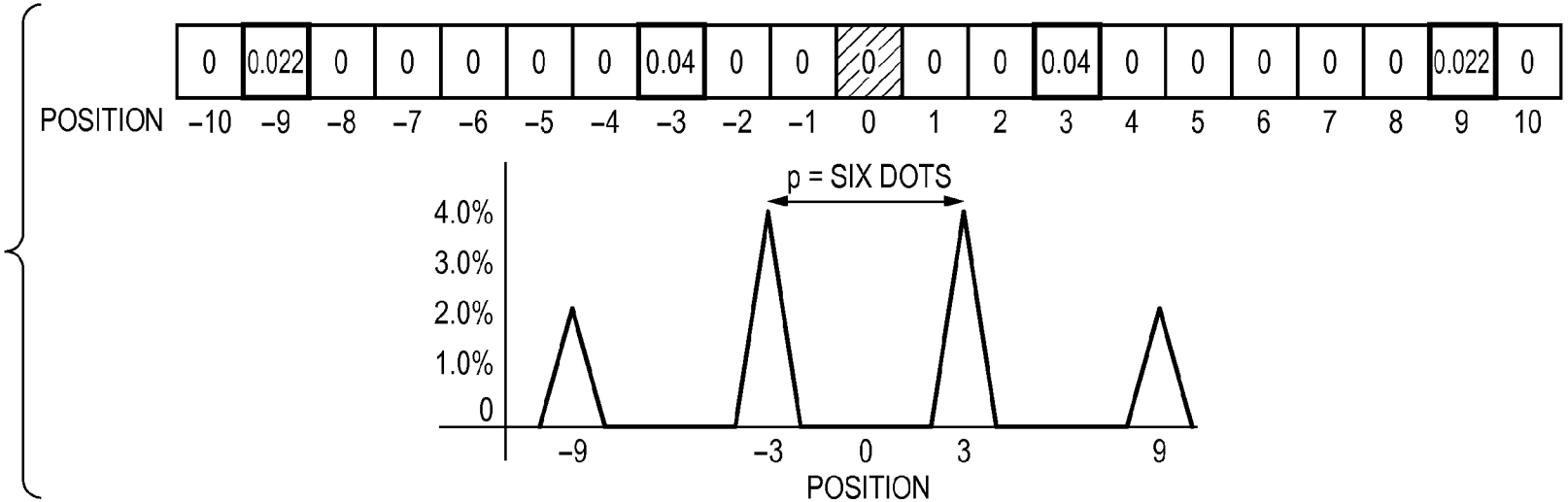
FIG. 17 is a diagram illustrating a ghost light profile according to an embodiment.
Figure 18A:
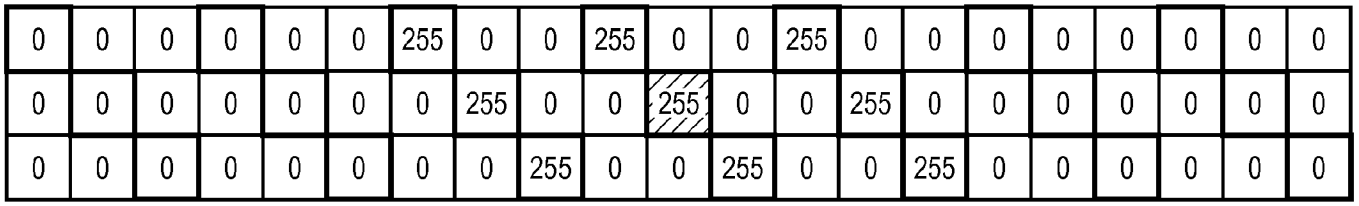
FIGS. 18A and 18B are diagrams illustrating a correction process according to an embodiment.
Figure 18B:
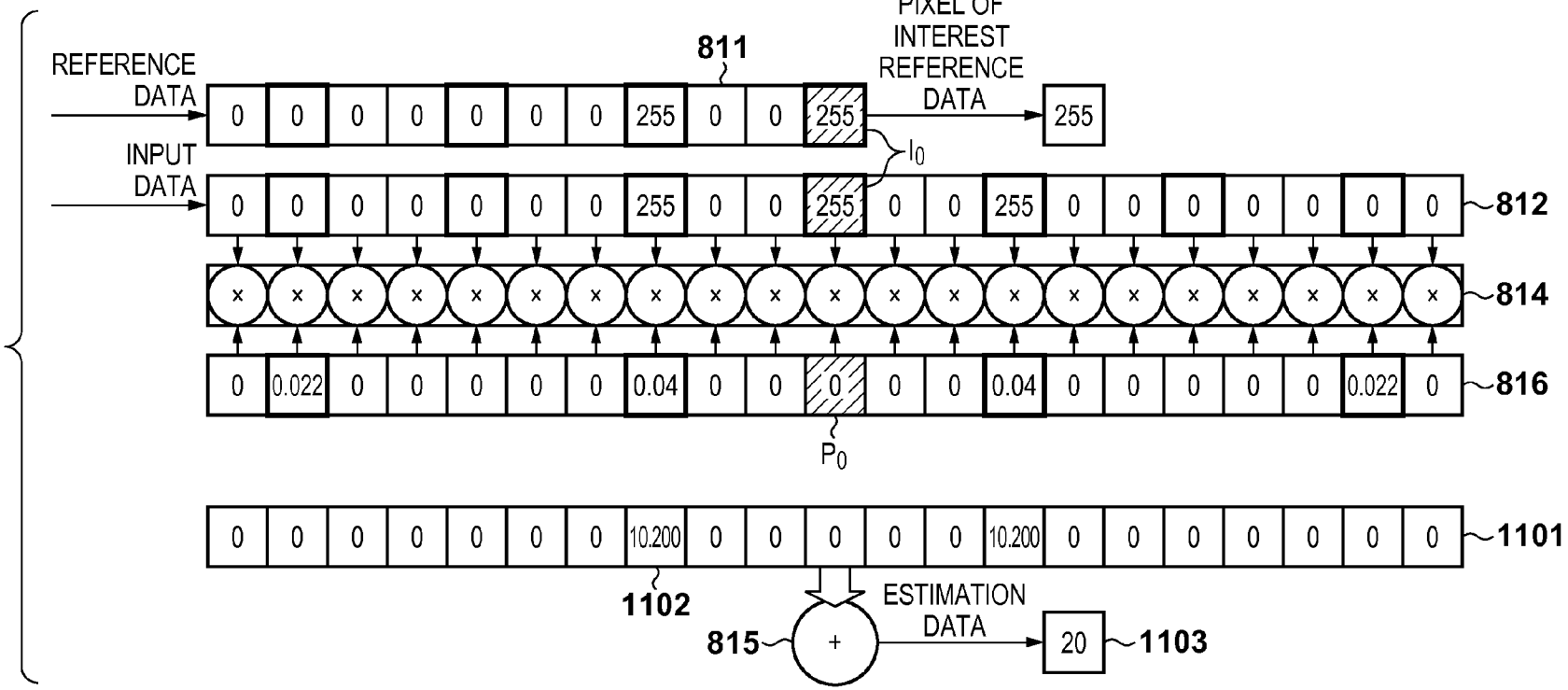

Because L=3 in the present embodiment, the lens array optical system 102 is designed so that the arrangement pitch p=2×3×n pixels. In the present example, the design is such that n=1 and p=6 pixels. As a result, the interval of peaks in the ghost light intensity is six dots. FIG. 17 is a diagram illustrating an example of the ghost light profile according to the present embodiment. Like FIG. 12A, FIG. 18A illustrates a state in which rendering data, in which the tone values of 10 consecutive pixels are 255 and the tone values of the other pixels are 0, has undergone the delay process performed by the delay processing unit 309. Note that the tone values enclosed by a bold line in FIG. 18A are tone values of pixels in the same scanning line of the photosensitive member 22K. FIG. 18B is a schematic diagram illustrating calculations performed by the ghost light intensity estimating unit 801 according to the rendering data shown in FIG. 18A.

As in the first embodiment, in FIG. 18B, the intensity of the ghost light produced at the pixel of interest is calculated based only on light from the light-emitting unit 704 that correspond to pixels in the same scanning line as the pixel of interest $I_0$. Although n=1 in the present example, the configuration may be such that n=2 or 3, or in other words, that the arrangement pitch is a multiple of every six dots, such as twelve dots, eighteen dots, or the like. Furthermore, although the first embodiment and the second embodiment describe cases where L=2 and 3, respectively, L can be set to any desired integer of 4 or more.

Note that the present invention can also be realized as an image processing apparatus that includes the ghost light processing unit 308 shown in FIG. 6 and that outputs rendering data to an image forming apparatus including the photosensitive member 22 and the exposure unit 24 described earlier.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-253614, filed Dec. 6, 2013, which is hereby incorporated by reference herein in its entirety.

What is claimed is:

1. An image forming apparatus comprising:

a photosensitive member; and an exposure unit, including a lens array optical system in which a plurality of lenses are disposed along a predetermined direction, and a light-emitting unit having a plurality of light-emitting elements disposed so as to expose, through the lens array optical system, every Lth pixel in L scanning lines of the photosensitive member, wherein an interval of locations of adjacent lenses, corresponding to pixels of the photosensitive member, in a main arrangement direction is 2×L×n, where n is any integer greater than or equal to 1, using a pixel of the photosensitive member as a unit of the interval.

2. The image forming apparatus according to claim 1, further comprising:

a correcting unit configured to estimate, from image data, an intensity of ghost light at a position of each pixel in the photosensitive member in a case where the photosensitive member is exposed by the exposure unit using the image data, and correct the image data based on the estimated intensity of the ghost light, wherein the exposure unit is further configured to expose the photosensitive member using the corrected image data.

3. The image forming apparatus according to claim 2, wherein the correcting unit holds information expressing a relationship between light from a light-emitting element corresponding to a predetermined pixel that is different from a pixel of interest and ghost light produced at a position of the pixel of interest on the photosensitive member by the light, and is further configured to estimate the intensity of the ghost light at the position of each pixel on the photosensitive member based on the information.

4. The image forming apparatus according to claim 3, wherein the correcting unit is further configured to use a tone value of each of one or more pixels in a predetermined positional relationship with the pixel of interest and the information to obtain intensities of the ghost light produced at the position of the pixel of interest on the photosensitive member based on light from the light-emitting elements corresponding to the one or more pixels, and estimate the intensity of the ghost light at the position of the pixel of interest as a sum of the obtained intensities of the ghost light.

5. An image forming apparatus comprising:

a photosensitive member; and an exposure unit, including a lens array optical system in which a plurality of lenses are disposed along a predetermined direction, and a light-emitting unit having a plurality of light-emitting elements disposed so as to expose, through the lens array optical system, every Lth pixel in L scanning lines of the photosensitive member, wherein an interval of locations of adjacent lenses, corresponding to pixels of the photosensitive member, in a main arrangement direction is 2×L×n, where n is any integer greater than or equal to 1, using a pixel of the photosensitive member as a unit of the interval.

6. The image forming apparatus according to claim 5, wherein the one or more pixels in a predetermined positional relationship with the pixel of interest include a plurality of pixels and an interval between adjacent pixels in the plurality of pixels is 2×L×n pixels.

7. The image forming apparatus according to claim 2, wherein the correcting unit is further configured to correct the image data by subtracting, from the tone value of each pixel in the image data, a value corresponding to the estimated intensity of the ghost light at a position of a corresponding pixel.

8. The image forming apparatus according to claim 1, wherein in the light-emitting unit, L columns of the plurality of light-emitting elements arranged in the predetermined direction are disposed in a direction different from the predetermined direction.

9. An image forming apparatus comprising:

a photosensitive member; and an exposure unit, including a lens array optical system in which a plurality of lenses are disposed along a predetermined direction, and a light-emitting unit having a plurality of light-emitting elements disposed so as to expose, through the lens array optical system, every Lth pixel in L scanning lines of the photosensitive member, wherein the lens array optical system is configured so that an interval of adjacent peaks in ghost light produced at the photosensitive member is 2×L×n pixels of the photosensitive member, where n is any integer greater than or equal to 1.

10. An image forming apparatus comprising:

a photosensitive member;

an exposure unit, including a lens array optical system in which a plurality of lenses are disposed along a predetermined direction, and a light-emitting unit having a plurality of light-emitting elements disposed so as to expose, through the lens array optical system, a plurality of scanning lines in the photosensitive member; and a correcting unit configured to, in a case where the photosensitive member is exposed by the exposure unit using image data, estimate an intensity of ghost light at the position of each pixel exposed in a first scanning line of the plurality of scanning lines based on the image data, estimate an intensity of ghost light at the position of each pixel exposed in a second scanning line that is different from the first scanning line based on the image data, and correct the image data based on the estimated ghost light intensities.

11. The image forming apparatus according to claim 10, wherein the correcting unit holds information expressing a relationship between light from a light-emitting element corresponding to a predetermined pixel that is different from a pixel of interest and ghost light produced at a position of the pixel of interest on the photosensitive member by the light, and is further configured to estimate the intensity of the ghost light at the position of each pixel on the photosensitive member based on the information.

12. The image forming apparatus according to claim 11, wherein an interval of the predetermined pixel is determined based on a number of the plurality of scanning lines.

13. An image processing apparatus that supplies data to an image forming apparatus for exposure by an exposure unit in the image forming apparatus, the image forming apparatus including a photosensitive member and an exposure unit, having a lens array optical system in which a plurality of lenses are disposed along a predetermined direction, and a plurality of light-emitting elements disposed so as to expose, through the lens array optical system, every Lth pixel in L scanning lines of the photosensitive member, and wherein an interval of locations of adjacent lenses in the lens array optical system, corresponding to pixels of the photosensitive member, is 2×L×n where n is any integer greater than or equal to 1, and a pixel of the photosensitive member is used as a unit of the interval, the image processing apparatus comprising:

a holding unit configured to hold a profile having information indicating a relationship between light emitted from light-emitting elements, in the plurality of light-emitting elements, that produce peaks in ghost light at the photosensitive member, and the ghost light;

an estimating unit configured to estimate an intensity of the ghost light at a position of each pixel in the photosensitive member based on image data and the profile; and an output unit configured to correct a pixel value of each pixel in the image data based on the estimated intensity of the ghost light at positions of corresponding pixels, and output the corrected image data to the exposure unit.

14. The image processing apparatus according to claim 13, wherein there are a plurality of light-emitting elements that produce peaks in the ghost light at the photosensitive member; and an interval between adjacent pixels, of a plurality of pixels corresponding to the plurality of light-emitting elements that produce peaks in the ghost light at the photosensitive member, is $2 \times L \times n$, where n is any integer greater than or equal to 1, pixels.

15. A non-transitory computer-readable storage medium including a program that causes a computer to function as an image processing apparatus that supplies data to an image forming apparatus for exposure by an exposure unit in the image forming apparatus, the image forming apparatus including a photosensitive member and an exposure unit, having a lens array optical system in which a plurality of lenses are disposed along a predetermined direction, and a plurality of light-emitting elements disposed so as to expose, through the lens array optical system, every Lth pixel in L scanning lines of the photosensitive member, wherein an interval of adjacent lenses in the lens array optical system is $2 \times L \times n$, where n is any integer greater than or equal to 1, and a pixel of the photosensitive member is used as a unit of the interval, the image processing apparatus comprising:

a holding unit configured to hold a profile having information indicating a relationship between light emitted from light-emitting elements, in the plurality of light-emitting elements, that produce peaks in ghost light at the photosensitive member, and the ghost light;

an estimating unit configured to estimate an intensity of the ghost light at a position of each pixel in the photosensitive member based on image data and the profile; and an output unit configured to correct a pixel value of each pixel in the image data based on the estimated intensity of the ghost light at positions of corresponding pixels, and output the corrected image data to the exposure unit.

* * * * *